US007251440B2

(12) United States Patent
Shigeta et al.

(10) Patent No.: US 7,251,440 B2
(45) Date of Patent: Jul. 31, 2007

(54) DEVELOPMENT APPARATUS AND IMAGE FORMATION APPARATUS

(75) Inventors: Kunio Shigeta, Hachioji (JP); Hiroshi Akita, Hachioji (JP); Seiko Itagaki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 299 days.

(21) Appl. No.: 10/802,807

(22) Filed: Mar. 18, 2004

(65) Prior Publication Data

US 2004/0213603 A1 Oct. 28, 2004

(30) Foreign Application Priority Data

Apr. 28, 2003 (JP) ..... 2003-124175
Apr. 28, 2003 (JP) ..... 2003-124176
Apr. 28, 2003 (JP) ..... 2003-124177

(51) Int. Cl.
*G03G 15/08* (2006.01)

(52) U.S. Cl. ..... 399/254; 399/53; 399/255; 399/260

(58) Field of Classification Search ..... 399/53, 399/254, 359, 258, 260, 255
See application file for complete search history.

(56) References Cited

U.S. PATENT DOCUMENTS 5,724,635 A * 3/1998 Nagaoka et al. ..... 399/260
5,842,090 A 11/1998 Mikawa
5,950,056 A * 9/1999 Hamamichi et al. ..... 399/256
6,122,472 A * 9/2000 Sako et al. ..... 399/254
6,336,022 B2 * 1/2002 Ichikawa et al. ..... 399/254
2002/0009309 A1 * 1/2002 Suzuki ..... 399/254
2002/0071697 A1 * 6/2002 Fujimoto ..... 399/254
2002/0098437 A1 * 7/2002 Kobayahsi et al. ..... 430/111.35
2003/0156859 A1 * 8/2003 Tamai ..... 399/254
2003/0219291 A1 * 11/2003 Tokimatsu et al. ..... 399/359
2004/0052538 A1 * 3/2004 Yugeta et al. ..... 399/258
2004/0265009 A1 * 12/2004 Shigeta et al. ..... 399/254

FOREIGN PATENT DOCUMENTS

JP 7-013420 1/1995
JP 9-166918 6/1997
JP 9-288412 11/1997

* cited by examiner

*Primary Examiner*—David M. Gray
*Assistant Examiner*—Ryan D. Walsh
(74) *Attorney, Agent, or Firm*—Finnegan, Henderson, Farabow, Garrett & Dunner, L.L.P.

(57) ABSTRACT

A development apparatus has: a housing in which a developer supplying/collecting unit and a developer stirring unit are arranged with a circular passage for carrying developer; a developer carrying member placed at a front side of the developer supplying/collecting unit; a developer supplying/collecting section for carrying the developer; and two developer stirring sections arranged in the front-and-rear direction so as to face, wherein, a toner supplying opening is formed above a position where the two developer stirring sections face and at an upstream side in a developer carrying direction, the two developer stirring sections are rotated at the facing position to move peripheries in a forward direction, the developer carrying direction by the two developer stirring sections is substantially opposite to one by the developer supplying/collecting section, and developer carrying capability of the two developer stirring sections is set to be made equal to that of the developer supplying/collecting section.

44 Claims, 13 Drawing Sheets

DEVELOPMENT APPARATUS AND IMAGE FORMATION APPARATUS

BACKGROUND OF THE PRESENT INVENTION

1. Field of the Present Invention

The present invention relates to a development apparatus and an image formation apparatus comprising such development apparatus.

2. Description of Related Art

In a type of image formation apparatus using an electrographic system, for example, a development method in which, with the use of two-component developer composed of toner and carrier, the friction-charged toner is carried to a development area by an appropriate stirring means, and the toner is absorbed on an electrostatic latent image formed on a latent image carrying member for forming a toner image, is used. In such development method with the use of two-component developer, in order to maintain even toner density in the developer, new toner is replenished according to toner consumption amount.

In such image formation apparatus, it is required to obtain more high-quality images. In response to the request, for example, toner having small particle diameter has been used. Further, in connection with the toner having smaller particle diameter, particle diameter of the carrier is also requested to become smaller.

Accordingly, while it is possible to form high-quality images with the use of toner having small particle diameter and carrier having small particle diameter, it is difficult to sufficiently stir developer due to the decrease of flowability of the developer itself. As a result, the newly replenished toner is supplied to the development area without reaching to a state of having predetermined electrostatic charging amount, and thereby there is a problem such as toner fog and toner blurring easily happening.

And such problem frequently happens when an image with high dot area percent is continuously output such as a case of forming a color image.

On the other hand, these days, in conjunction with the increase of social consciousness regarding environmental safeguard, for example, resource saving, such as toner recycling or the like, has been attempted.

However, since toner collected after once having been used for development has inferior electrostatic charging characteristic to unused toner, there is a problem of toner fog and toner blurring due to insufficient toner electrostatic charging amount.

According to such problem, conventionally, a number of arts improving stirring efficiency of developer have been proposed. For example, structuring to have a stirring means having high developer carrying capability with a member serving as an auxiliary stirring member has been proposed (see Japanese Patent Application Publications (Unexamined) Nos. Tokukai-Hei 7-13420, Tokukai-Hei 9-166918 and Tokukai-Hei 9-288412).

However, in any of the above-mentioned arts, while stirring efficiency of developer is improved, circulation carrying speed of developer in the development apparatus decreases. As a result, toner density of developer supplied to the developer carrying member with respect to a rotation axis direction of the developer carrying member becomes uneven, and, in particular, when an image having high dot area percent is to be output continuously, it is easy that image density unevenness significantly happens, and thereby there is a problem that it is difficult to securely form a high-quality image.

As mentioned, if one tries to prevent the occurrence of toner fog and toner blurring by improving stirring capability of developer so as to make replenished new toner have sufficient electrostatic charging amount, there is a problem that it becomes easy that image density unevenness happens due to the decrease of carrying capability of developer. Consequently, the actuality is, it is difficult to solve two problems at the same time, the two problems that the occurrence of toner fog and toner blurring, and the occurrence of image density unevenness.

SUMMARY OF THE PRESENT INVENTION

The present invention is made based on the above-mentioned circumstance. An object of the present invention is to provide a development apparatus and an image formation apparatus having a structure where it is possible to obtain sufficient stirring capability of developer without reducing carrying speed of the developer, and thereby it is possible to securely form high-quality images.

In accordance with a first aspect of the present invention, a development apparatus comprises: a housing in which a developer supplying/collecting unit and a developer stirring unit are arranged in a front-and-rear direction, the developer supplying/collecting unit and the developer stirring unit together forming a circular passage so as to communicate each other for carrying two-component developer which is composed of toner and carrier; a developer carrying member which is placed at a front side portion of the developer supplying/collecting unit so as to face a latent image carrying member with respect to a development region; a developer supplying/collecting section for carrying the developer in a rotation axis direction thereof by being rotated, the developer supplying/collecting section placed at a rear side portion of the developer supplying/collecting unit so as to face the developer carrying member and to extend along a rotation axis direction of the developer carrying member; and two developer stirring sections which are arranged in the front-and-rear direction in the developer stirring unit so as to face each other and to extend along a rotation axis direction of the developer supplying/collecting section, wherein, in the housing, a toner supplying opening is formed above a position where the two developer stirring sections of the developer stirring unit face each other and at an upstream side in a developer carrying direction in the developer stirring unit, the two developer stirring sections are rotated at the position where the two developer stirring sections face each other so as to move peripheries thereof up to down in a forward direction to each other, the developer carrying direction by the two developer stirring sections is substantially opposite to a developer carrying direction by the developer supplying/collecting section, and developer carrying capability of each of the two developer stirring sections is set so as to make sum total of developer carrying amount by the two developer stirring sections equal to that by the developer supplying/collecting-section.

According to the above-mentioned apparatus, while the developer is circularly carried by balancing a developer carrying speed of the two developer stirring sections in the developer stirring unit and the developer supplying/collecting section and the two developer stirring sections stirs the developer in a circumferential direction with the developer carried in the rotation axis direction, it is possible to secure sufficient mixing and stirring time of the developer in the developer stirring unit without reducing the developer carrying speed. As a result, the toner is charged up to a predetermined charging amount (electrostatic amount) with the mixing stirring operation to the developer in the developer stirring unit, and is supplied to the developer carrying member with even toner density in the axial direction by the developer supplying/collecting section. Thereby, it is possible to securely prevent the occurrence of image fog and toner blurring due to insufficient charging amount of toner.

Further, by rotating the two developer stirring sections at a position where the two developer stirring sections face each other so as to move each periphery thereof up to down in a forward direction to each other, and by having a structure where toner is supplied from above or upstream of the position of the two developer stirring sections facing each other (a structure to let the toner fall under gravity), the replenished toner is sunk with acceleration into the developer at the toner replenishing point and dispersed evenly into the developer, it is possible to secure sufficient stirring time, and to stir the toner sufficiently in the developer stirring unit.

Preferably, in the apparatus of the first aspect of the present invention, one of the two developer stirring sections in the developer stirring unit carries the developer in a direction opposite to a direction in which the developer supplying/collecting section carries the developer and has the developer carrying capability in the rotation axis direction equal to that of the developer supplying/collecting section, and another developer stirring section has substantially no developer carrying capability in the rotation axis direction.

According to the above-mentioned apparatus, while the developer carrying speed is balanced by circularly carrying the developer with the use of the one developer stirring section having the developer carrying capability in the rotation axis direction equal to that of the developer supplying/collecting section and the developer supplying/collecting section, and the two developer stirring sections stirs the developer in a circumferential direction with the developer carried in the rotation axis direction, it is possible to secure sufficient mixing and stirring time of the developer in the developer stirring unit without reducing the developer carrying speed. As a result, the toner is charged up to a predetermined charging amount (electrostatic amount) with the mixing stirring operation to the developer in the developer stirring unit, and is supplied to the developer carrying member with even toner density in the axial direction by the developer supplying/collecting section. Thereby, it is possible to securely prevent the occurrence of image fog and toner blurring due to insufficient charging amount of toner.

Preferably, in the apparatus of the first aspect of the present invention, both the two developer stirring sections in the developer stirring unit carry the developer in a direction opposite to a direction in which the developer supplying/collecting section carries the developer, and have the developer carrying capability so as to make the sum total of the developer carrying amount by the two developer stirring sections in the rotation axis direction equal to that by the developer supplying/collecting section.

According to the above-mentioned apparatus, the developer supplying/collecting section and the two developer stirring sections having the developer carrying capability so as to make sum total of the developer carrying amount by each developer stirring section equal to that by the developer supplying/collecting section, circularly carry the developer in opposite directions to each other for balancing the developer carrying speed, and the two developer stirring sections stir the developer in the circumferential direction with the developer carried in the rotation axis direction. Therefore, it is possible to secure sufficient mixing and stirring time of the developer in the developer stirring unit without reducing the developer carrying speed. As a result, mixing and stirring operation of the developer is performed in the developer stirring unit, and it is possible to securely prevent the occurrence of image fog and toner blurring due to insufficient charging amount of toner.

Preferably, in the apparatus of the first aspect of the present invention, one of the two developer stirring sections in the developer stirring unit carries the developer in a same direction as a direction in which the developer supplying/collecting section carries the developer, and has the developer carrying capability in the rotation axis direction lower than that of the developer supplying/collecting section, and another developer stirring section carries the developer in a direction opposite to a direction in which the developer supplying/collecting section carries the developer, and has the developer carrying capability so as to make the developer carrying amount by another developer stirring section equal to the sum total of that by the developer supplying/collecting section and the one developer stirring section.

According to the above-mentioned apparatus, the developer carrying speed is balanced by circularly carrying the developer with the use of one developer stirring section having lower developer carrying capability than another, another developer stirring section having the developer carrying capability equal to total sum of that of the one developer stirring section and the developer supplying/collecting section, and the two developer stirring sections stir the developer in the circumferential direction with the developer carrying in the rotation axis direction. As a result, the mixing and stirring operation of the developer is performed in the developer stirring unit without reducing the developer carrying speed, and it is possible to securely prevent the occurrence of image fog and toner blurring due to insufficient charging amount of toner.

Preferably, in the apparatus of the first aspect of the present invention, in the developer stirring unit, another developer stirring section having substantially no developer carrying capability in the rotation axis direction is placed at a rear side with respect to the developer supplying/collecting unit.

According to the above-mentioned apparatus, since the developer stirring section having substantially no developer carrying capability in the rotation axis direction is placed at a rear side with respect to the developer supplying/collecting unit, it is possible to securely prevent stagnation of the developer, which could easily happen near the passage between the developer supplying/collecting unit and the developer stirring unit, to thereby circulate the developer smoothly. With this structure, the developer can be supplied to the developer carrying member with even toner density in the axial direction Preferably, in the apparatus of the first aspect of the present invention, the two-component developer is composed of the toner having a volume average particle diameter of 3 μm to 5 μm, and, denoting the volume average particle diameter of the toner by Dt (μm), the carrier having volume average particle diameter of 5×Dt to 10×Dt.

According to the above-mentioned apparatus, with the use of small-particle toner having a volume average particle diameter of 3 μm to 5 μm, it is possible to steadily form a toner image with high resolution and excellent reproducibility of thin lines as well as with stable image density in solid portions.

Further, by making a volume average particle diameter of carrier fifth to tenth time as large as that of the toner, electrostatic charging capability to be imparted on the surface of the carrier can be improved even if small-size toner is used. This use of carrier securely prevents the occurrence of toner fog and blurring, and therefore it is possible to steadily obtain excellent images with fine and even image density.

Preferably, in the apparatus of the first aspect of the present invention, the developer supplying/collecting section comprises a stirring member extending spirally in the rotation axis direction throughout an outer periphery of a shaft member, one of the two developer stirring sections comprises a stirring member extending spirally in the rotation axis direction throughout an outer periphery of a shaft member, the stirring member carrying the developer in a direction opposite to a direction in which the developer supplying/collecting section carries the developer with the developer stirred, and has the developer carrying capability in the rotation axis direction equal to that of the developer supplying/collecting section, and another developer stirring section comprises a plurality of plate-like stirring members with a shaft member passing through, the plurality of stirring members inclined in a same direction with respect to the shaft member, and has substantially no developer carrying capability in the rotation axis direction.

According to the above-mentioned apparatus, developer carrying speed is balanced by circularly carrying the developer in the developer stirring unit with the use of one developer stirring section composed of a stirring member spirally extending in the rotation axis direction throughout an outer periphery of a shaft member and the developer supplying/collecting section composed of a stirring member extending spirally in the rotation axis direction throughout an outer periphery of a shaft member, and another developer stirring section composed of a plurality of plate-like stirring members with a shaft member passing through, the plurality of stirring member being inclined in the same direction with respect to the shaft member stirs the developer in the circumferential direction without carrying the developer in the rotation axis direction. Thereby, the mixing and stirring operation of the developer is performed in the developer stirring unit without reducing the developer carrying speed. As a result, it is possible to securely prevent the occurrence of toner fog and toner blurring due to insufficient toner charging from occurring, and also it is possible to prevent uneven image density on obtained visualized images from occurring.

Preferably, in the apparatus of the first aspect of the present invention, the developer supplying/collecting section comprises a stirring member extending spirally in the rotation axis direction throughout an outer periphery of a shaft member, one of the two developer stirring sections comprises a stirring member extending spirally in the rotation axis direction throughout an outer periphery of a shaft member, the stirring member carrying the developer in a direction opposite to a direction in which the developer supplying/collecting section carries the developer with the developer stirred, and has the developer carrying capability in the rotation axis direction equal to that of the developer supplying/collecting section, and another developer stirring section comprises a stirring member comprising a rib placed on an outer periphery of a shaft member or at a position with being apart from each other with respect to the shaft member in a radial direction so as to extend along the rotation axis direction, and has substantially no developer carrying capability in the rotation axis direction.

According to the above-mentioned apparatus, developer carrying speed is balanced by circularly carrying the developer in the developer stirring unit with the use of the developer supplying/collecting section having a stirring member extending spirally in the rotation axis direction throughout an outer periphery of a shaft member and one developer stirring section having a stirring member extending spirally in the rotation axis direction throughout an outer periphery of a shaft member, and another developer stirring section having a stirring member comprising a rib placed on an outer periphery of a shaft member or at a position with being apart from each other with respect to the shaft member in a radial direction so as to extend along the rotation axis direction stirs the developer in the circumferential direction without carrying the developer in the rotation axis direction. Thereby, the mixing and stirring operation of the developer is performed in the developer stirring unit without reducing the developer carrying speed. As a result, it is possible to securely prevent the occurrence of toner fog and toner blurring due to insufficient toner charging from occurring, and also it is possible to prevent uneven image density on obtained visualized images from occurring.

Preferably, in the apparatus of the first aspect of the present invention, the developer supplying/collecting section comprises a stirring member extending spirally in the rotation axis direction throughout an outer periphery of a shaft member, one of the two developer stirring sections comprises a stirring member extending spirally in the rotation axis direction throughout an outer periphery of a shaft member, and another developer stirring section comprises a plurality of semioval first stirring members and a plurality of semioval second stirring members on an outer periphery of a shaft member, the plurality of first stirring members being placed along a first stirring member arrangement plane, the plurality of second stirring members being placed along a second stirring member arrangement plane, the first stirring member arrangement plane and the second stirring member arrangement plane being inclined in different directions from each other with respect to a plane perpendicular to the shaft member.

According to the above-mentioned apparatus, while developer carrying speed is balanced by circularly carrying the developer in the developer stirring unit with the use of two developer stirring sections, which are one developer stirring section having a stirring member extending spirally in the rotation axis direction throughout an outer periphery of a shaft member and another developer stirring section having a plurality of semioval first stirring members and a plurality of semioval second stirring members on an outer periphery of a shaft member, the plurality of first stirring members being placed along a first stirring member arrangement plane, the plurality of second stirring members being placed along a second stirring member arrangement plane, the first stirring member arrangement plane and the second stirring member arrangement plane being inclined in different directions from each other with respect to a plane perpendicular to the shaft member, and the developer supplying/collecting section having a stirring member extending spirally in the rotation axis direction throughout an outer periphery of a shaft member, the two developer stirring sections stir the developer in the circumferential direction without reducing the developer carrying speed. As a result, the mixing and stirring operation of the developer in the developer stirring unit is sufficiently performed, and it is possible to securely prevent the occurrence of toner fog and toner blurring due to insufficient toner charging from occurring, and also it is possible to prevent uneven image density on obtained visualized images from occurring.

Preferably, in the apparatus of the first aspect of the present invention, the developer supplying/collecting section comprises a stirring member extending spirally in the rotation axis direction throughout an outer periphery of a shaft member, one of the two developer stirring sections comprises a stirring member extending spirally in the rotation axis direction throughout an outer periphery of a shaft member, and another developer stirring section comprises a stirring member comprising a rib placed on an outer periphery of a shaft member or at a position with being apart from each other with respect to the shaft member in a radial direction so as to extend along the rotation axis direction.

According to the above-mentioned apparatus, while developer carrying speed is balanced by circularly carrying the developer in the developer stirring unit with the use of two developer stirring sections, which are one developer stirring section having a stirring member extending spirally in the rotation axis direction throughout an outer periphery of a shaft member and another developer stirring section having a stirring member comprising a rib placed on an outer periphery of a shaft member or at a position with being apart from each other with respect to the shaft member in a radial direction so as to extend along the rotation axis direction, the two developer stirring sections stir the developer in the circumferential direction without reducing the developer carrying speed. As a result, the mixing and stirring operation of the developer is performed in the developer stirring unit, and it is possible to securely prevent the occurrence of toner fog and toner blurring due to insufficient toner charging from occurring, and also it is possible to prevent uneven image density on obtained visualized images from occurring.

Preferably, in the apparatus of the first aspect of the present invention, the developer supplying/collecting section comprises a stirring member extending spirally in the rotation axis direction throughout an outer periphery of a shaft member, the one of the two developer stirring sections having lower developer carrying capability, comprises a plurality of semioval first stirring members and a plurality of semioval second stirring members on an outer periphery of a shaft member, the plurality of first stirring members being placed along a first stirring member arrangement plane, the plurality of second stirring members being placed along a second stirring member arrangement plane, the first stirring member arrangement plane and the second stirring member arrangement plane being inclined in different directions from each other with respect to a plane perpendicular to the shaft member, and has the developer carrying capability in the rotation axis direction lower than that of the developer supplying/collecting section, and another developer stirring section having higher developer carrying capability, comprises a stirring member extending spirally in the rotation axis direction throughout an outer periphery of a shaft member, and has the developer carrying capability so as to make the developer carrying amount by another developer stirring section equal to the sum total of that by the developer supplying/collecting section and the one developer stirring section.

According to the above-mentioned apparatus, while developer carrying speed is balanced by circularly carrying the developer in the developer stirring unit with the use of one developer stirring section having a plurality of semioval first stirring members and a plurality of semioval second stirring members on an outer periphery of a shaft member, the plurality of first stirring members being placed along a first stirring member arrangement plane, the plurality of second stirring members being placed along a second stirring member arrangement plane, the first stirring member arrangement plane and the second stirring member arrangement plane being inclined in different directions from each other with respect to a plane perpendicular to the shaft member and having the developer carrying capability in the rotation axis direction lower than that of the developer supplying/collecting section, the developer supplying/collecting section having a stirring member extending spirally in the rotation axis direction throughout an outer periphery of a shaft member and another developer stirring section having higher developer carrying capability and comprising a stirring member extending spirally in the rotation axis direction throughout an outer periphery of a shaft member, the two developer stirring sections stir the developer in the circumferential direction while carrying the developer in the rotation axis direction. As a result, the mixing and stirring operation of the developer is sufficiently performed in the developer stirring unit without reducing the developer carrying speed, and it is possible to securely prevent the occurrence of toner fog and toner blurring due to insufficient toner charging from occurring, and also it is possible to prevent uneven image density on obtained visualized images from occurring.

Preferably, in the apparatus of the first aspect of the present invention, the developer supplying/collecting section comprises a stirring member extending spirally in the rotation axis direction throughout an outer periphery of a shaft member, the one of the two developer stirring sections having lower developer carrying capability, comprises a stirring member comprising a rib placed on an outer periphery of a shaft member or at a position with being apart from each other with respect to the shaft member in a radial direction so as to extend along the rotation axis direction, and has the developer carrying capability in the rotation axis direction lower than that of the developer supplying/collecting section, and another developer stirring section comprises a stirring member extending spirally in the rotation axis direction throughout an outer periphery of a shaft member, and has the developer carrying capability so as to make the developer carrying amount by another developer stirring section equal to the sum total of that by the developer supplying/collecting section and the one developer stirring section.

According to the above-mentioned apparatus, developer carrying speed is balanced by circularly carrying the developer in the developer stirring unit with the use of one developer stirring section having a stirring member comprising a rib placed on an outer periphery of a shaft member or at a position with being apart from each other with respect to the shaft member in a radial direction so as to extend along the rotation axis direction and having lower developer carrying capability in the rotation axis direction, the developer supplying/collecting section having a stirring member extending spirally in the rotation axis direction throughout an outer periphery of a shaft member and another developer stirring member having a stirring member extending spirally in the rotation axis direction throughout an outer periphery of a shaft member, and the two developer stirring sections stir the developer in the circumferential direction while carrying the developer in the rotation axis direction. Thereby, the mixing and stirring operation of the developer is sufficiently performed in the developer stirring unit without reducing the developer carrying speed. As a result, it is possible to securely prevent the occurrence of toner fog and toner blurring due to insufficient toner charging from occurring, and also it is possible to prevent uneven image density on obtained visualized images from occurring.

Preferably, in the apparatus of the first aspect of the present invention, one of the two developer stirring sections in the developer stirring unit has the developer carrying capability in the rotation axis direction lower than or equal to that of another developer stirring section, and is placed at a rear side with respect to the developer supplying/collecting unit.

According to the above-mentioned apparatus, since the two developer stirring sections share the developer carrying amount in the axial direction by the developer supplying/collecting section so as to secure the balance of the developer carrying speed, it is possible to make the developer carrying speed of each of the developer stirring sections relatively smaller than that of the structure securing the balance of the developer carrying speed with one developer stirring section. Thereby, it is possible to have sufficient mixing and stirring time without reducing the developer carrying speed in the entire development apparatus, and to secure a predetermined electrostatic amount in the toner.

Further, since another developer stirring section having the developer carrying capability in the rotation axis direction equal to or lower than that of the one developer stirring section is placed at a rear side with respect to the developer supplying/collecting unit, it is possible to securely prevent stagnation of the developer, which could easily happen near the passage between the developer supplying/collecting unit and the developer stirring unit, to thereby circulate the developer smoothly. With this structure, the developer can be supplied to the developer carrying member with even toner density.

Preferably, in the apparatus of the first aspect of the present invention, another developer stirring section in the developer stirring unit has the developer carrying capability in the rotation axis direction equal to or lower than that of the one developer stirring section, and is placed at a rear side with respect to the developer supplying/collecting unit.

According to the above-mentioned apparatus, since another developer stirring section having the developer carrying capability in the rotation axis direction equal to or lower than that of the one developer stirring section is placed at a rear side with respect to the developer supplying/collecting unit, it is possible to securely prevent stagnation of the developer, which could easily happen near the passage between the developer supplying/collecting unit and the developer stirring unit, to thereby circulate the developer smoothly. With this structure, the developer can be supplied to the developer carrying member with even toner density.

Preferably, in the apparatus of the first aspect of the present invention, in the developer stirring unit, another developer stirring section having higher developer carrying capability is placed at a rear side with respect to the developer supplying/collecting unit.

According to the above-mentioned apparatus, since another developer stirring section having higher developer carrying capability is placed at a rear side with respect to the developer supplying/collecting unit, it is possible to securely prevent the developer from stagnating near the passage between the developer supplying/collecting unit and the developer stirring unit, to thereby circulate the developer smoothly. With this structure, the developer can be supplied to the developer carrying member with even toner density.

Preferably, an image formation apparatus comprises a latent image carrying member, and a toner image formation section for forming a toner image by developing an electrostatic latent image formed on the latent image carrying member, wherein the toner image formation section includes the development apparatus of the first aspect of the present invention, and following conditions (1) and (2) are satisfied:

$$W \geqq M \times V \times L/1000 \qquad \text{Condition (1)}$$

$$R \leqq 600 \qquad \text{Condition (2)}$$

where V represents a moving speed (mm/sec) of the latent image carrying member, M represents maximum toner amount attaching to one unit area in the toner image formed on the latent image carrying member (mg/cm$^2$), L represents maximum width (mm) of the toner image formed on the latent image carrying member in a direction perpendicular to a moving direction of the latent image carrying member, W represents developer carrying amount (g/sec) by the developer supplying/collecting section in the rotation axis direction, and R represents rotation number of the developer supplying/collecting section.

If the developer carrying amount W in the axial direction by the developer supplying/collecting section is too small, the toner density in the developer, at the developer supplying region of the downstream in the developer carrying direction of the supplying/collecting section 25, becomes lower, and the toner is not sufficiently supplied to the development region, and thereby uneven image density easily occurs. If the rotation speed R of the developer supplying/collecting section 25 is too high, the shaft portion gets heated, and thereby the developer easily gets deteriorated, which ends up to be difficult to form high quality images. According to the above-mentioned image formation apparatus, by having a structure satisfying the above-mentioned conditions (1) and (2), since the developer carrying amount in the axial direction by the developer supplying/collecting section is suitably set and the rotation number of the developer supplying/collecting section is also suitably set, it is possible to prevent the above-mentioned problems.

Preferably, an image formation apparatus comprises a latent image carrying member, a toner image formation section for forming a toner image by developing an electrostatic latent image formed on the latent image carrying member, a transferring section for transferring the toner image on the latent image carrying member to transferring material or an intermediate transferring member, a cleaning section for removing toner remained on the latent image carrying member after the toner image is transferred, and a toner recycling section for collecting the toner removed from the latent image carrying member to be reused, wherein the toner image formation section includes the development apparatus of the first aspect of the present invention, and in the housing structuring the development apparatus, a recycled toner mixing opening is placed above the position where the two developer stirring sections face each other and at an upstream side with respect to the toner supplying opening in the developer carrying direction in the developer stirring unit, for mixing the toner collected by the toner recycling section into the developer stirring unit.

According to the above-mentioned image formation apparatus, since the recycled toner mixing opening is provided above the position where the two developer stirring sections face each other and at an upstream side with respect to the toner supplying opening in the developer carrying direction, it is possible to give the recycled toner sufficient stirring time in the developer stirring unit and to accelerate the toner sinking into the developer by falling from the above for sufficiently mixing and stirring the developer. Thereby, even in the case of using the developer having electrostatic charging characteristic lower than non-used toner, it is possible to prevent the occurrence of toner fog and toner blurring, and further to securely form a quality image with even image density.

Preferably, in the apparatus of the first aspect of the present invention, in the developer supplying/collecting unit, peripheries of the developer carrying member and the developer supplying/collecting section are moved in opposite directions to each other at a position where the developer carrying member and the developer supplying/collecting section face each other.

According to the above-mentioned apparatus, it is possible to securely exchange between the developer supplied from the developer supplying/collecting section to the developer carrying section and the developer collected by the developer supplying/collecting section after the toner is consumed on the developer carrying member.

Preferably, in the apparatus of the first aspect of the present invention, in the housing, there is a partition between the developer supplying/collecting unit and the developer stirring unit for separating space so as to avoid mixing the developer in the developer supplying/collecting unit and the developer in the developer stirring unit; the partition enables the developer in both the developer supplying/collecting unit and the developer stirring unit to move to each other at both edge parts in a longitudinal direction of both the developer supplying/collecting unit and the developer stirring unit; and a space is secured between the two developer stirring section in the developer stirring unit so as to make the developer circulate between the two developer stirring section freely.

According to the above-mentioned apparatus, it is possible to securely supply and collect the developer in the developer supplying/collecting unit without supplying/collecting operation and stirring operation of the developer interfering each other. Further, in the developer stirring unit, it is possible to securely charge the toner with sufficient electrostatic amount, and thereby it is possible to suitably supply and collect the toner in the latent image carrying member without both the operations interfering each other.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein.

EMBODIMENTS OF THE PRESENT INVENTION

First Embodiment

Hereinafter, a first embodiment of the present invention will be described.

Figure 1:
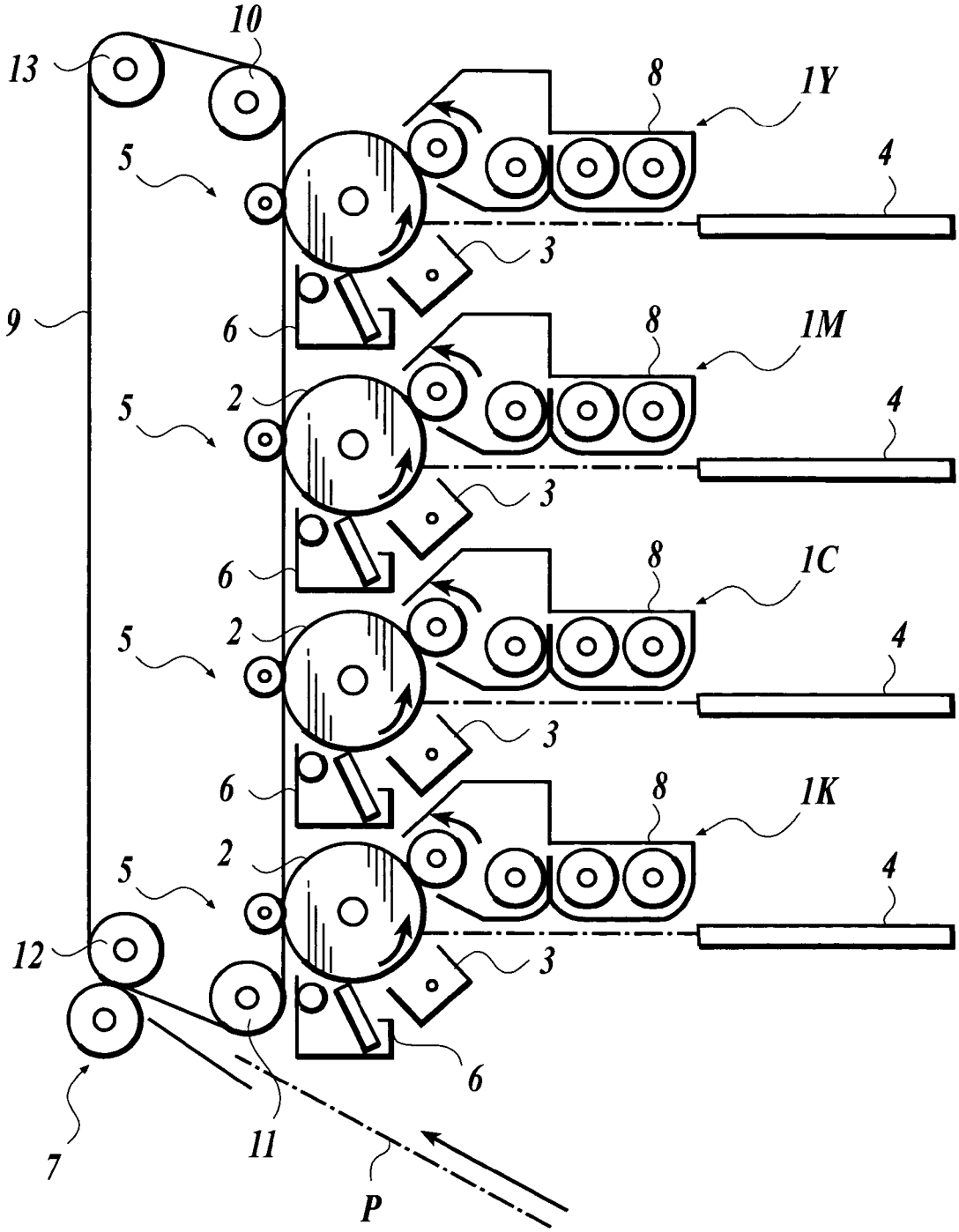
FIG. 1 is a pattern diagram showing a whole structure of an image formation apparatus according to the present invention.
Figure 2:
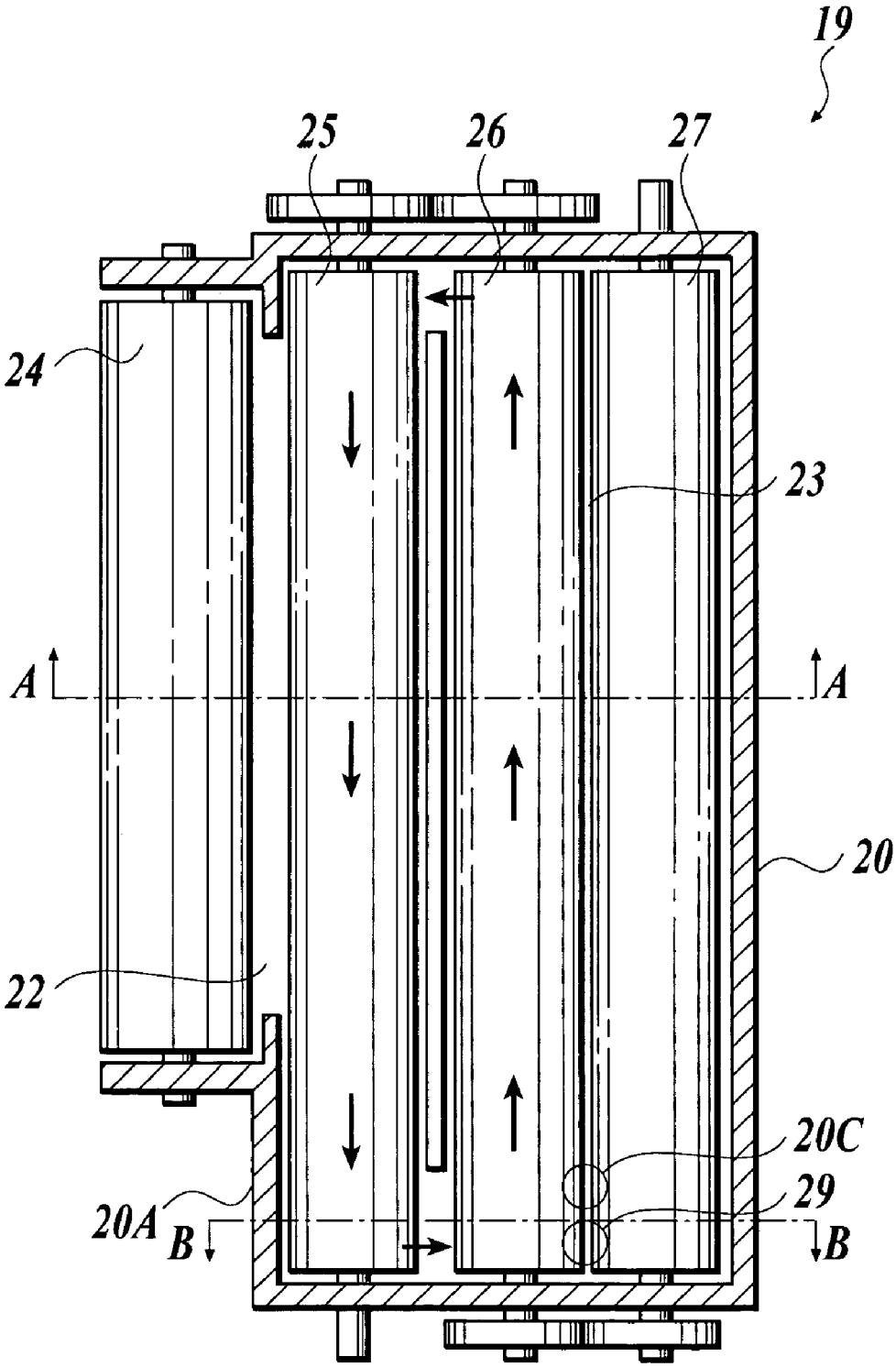
FIG. 2 is a partial cross-sectional pattern diagram showing a rough structure of a development apparatus in the first embodiment according to the present invention.
Figure 3:
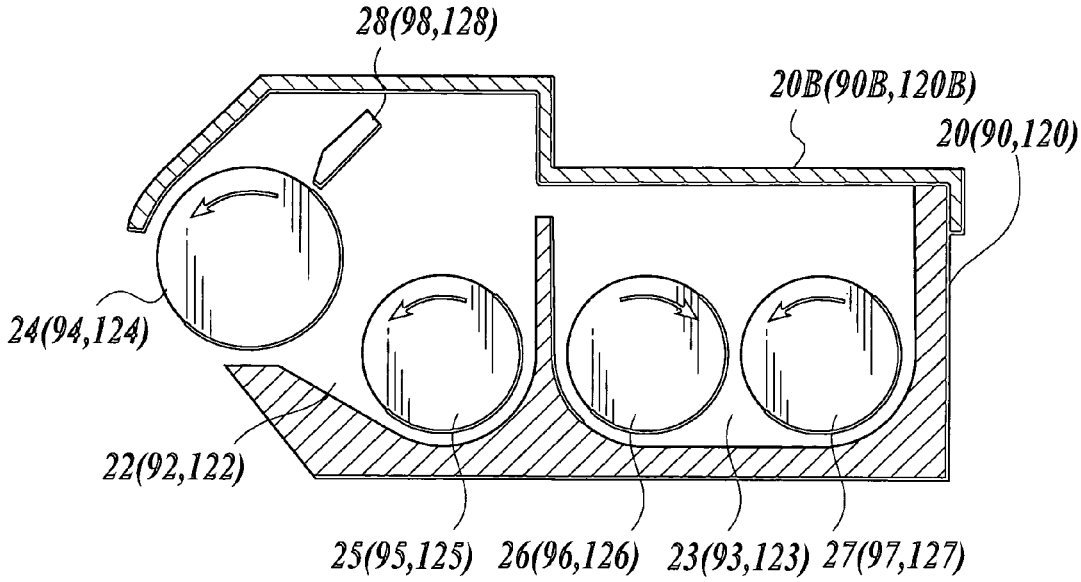
FIG. 3 is a vertical cross-sectional pattern diagram showing the rough structure of the development apparatus in the first to third embodiments according to the present invention taken along the line A-A.
Figure 4:
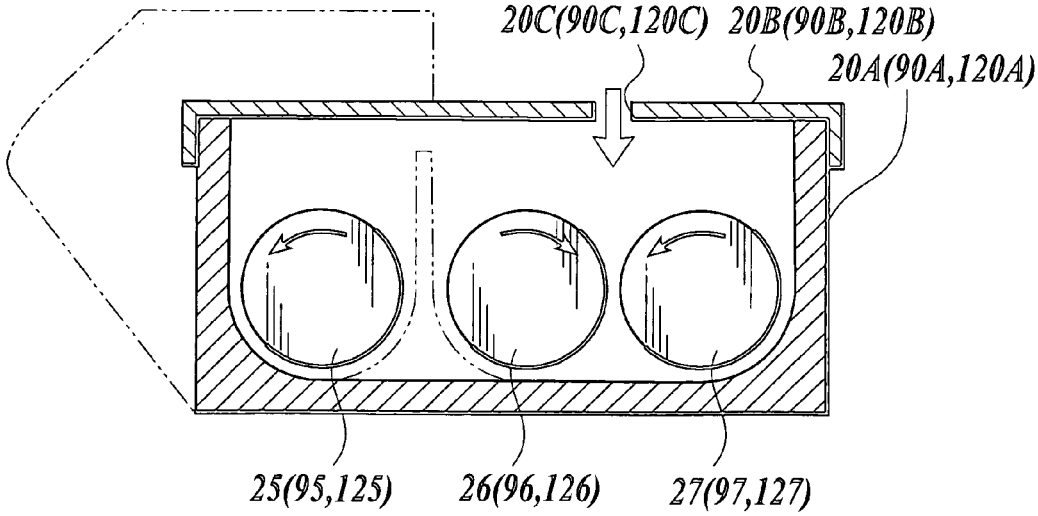
FIG. 4 is a vertical cross-sectional pattern diagram showing the rough structure of the development apparatus in the first to third embodiments according to the present invention taken along the line B-B.

FIG. 1 is a schematic illustration showing the construction of one example of an image formation apparatus according to the present invention; FIG. 2 is a partial cross-sectional schematic view showing the construction of one example of a development apparatus according to the present invention; FIG. 3 is a vertical cross sectional view taken along the line A-A of FIG. 2; and FIG. 4 is a vertical cross-sectional view taken along the line B-B of FIG. 2.

The image formation apparatus has an edgeless-belt type intermediate transferring member (hereinafter referred to as "intermediate transferring belt") 9 looped around a plurality of supporting rollers 10, 11, 12 and 13. Along the outer periphery of the intermediate transferring belt 9, provided are four toner image forming units 1Y, 1M, 1C and 1K for forming toner images having different colors from each other. The toner image forming units associated with respective colors are arranged apart from each other with an interval so that the intermediate transferring belt 9 could circularly move while being in contact with latent image carrying members 2, 2, 2 and 2 within the respective toner image forming units. At downstream side of the toner image forming unit disposed-area in a moving direction of the intermediate transferring belt 9, provided is a secondary transferring mechanism 7.

The developer supplying/collecting section 25 is preferably composed of a rotating member having high developer carrying capability in the rotation axis direction in view of preventing uneven toner density from occurring in the rotation axis direction.

The toner image forming unit 1Y for a yellow toner image comprises the latent image carrying member 2 of a rotating drum, and also a charging section 3, an exposing section 4, a toner image forming section (also called a development apparatus) 8, a primary transferring mechanism 5 and a latent image carrying member cleaning section 6. These components are arranged in an operational order in a rotating direction along the outer periphery of the latent image carrying member 2.

The toner image forming units 1M, 1C and 1K for respective magenta, cyan and black toner images also have the same construction as of the unit 1Y for yellow toner images.

The latent image carrying members 2, 2, 2, 2 in each toner image forming unit have an organic photosensitive body in which a photosensitive layer composed of, for example, polycarbonate resin containing organic photoconductor, is formed on the peripheral surface of the metal based drum.

The toner image forming sections 8, 8, 8, 8 comprise a development apparatus, for example, constructed as shown in FIG. 2 to FIG. 4. Hereafter, such a development apparatus will be described in detail. In this specification, the term "front-and-rear direction" means a left-and-right direction in FIG. 2, "axial direction" means an up-and-down direction in FIG. 2, and "up-and-down direction" means an up-and-down direction in FIG. 3 and FIG. 4.

The development apparatus has a housing 20 in which a developer supplying/collecting unit 22 and a developer stirring unit 23 are disposed in front-and-rear direction to form a circular passage for carrying the two-component toner composed of toner and carrier, the circular passage passing through each other at both the ends thereof in the axial direction.

In the developer supplying/collecting unit 22, provided at the position of facing the latent image carrying member 2 at its front side is a developer carrying member 24 opposed to the latent image carrying member 2 through the development area and extending in the axial direction with the axis rotatably supported, for bearing and carrying the developer with its-rotation toward a circumferential direction. Also, provided at the rear side and closer to the developer stirring unit 23 in the developer supplying/collecting unit 22 is a developer supplying/collecting section 25 facing the developer carrying member 24 and extending in the axial direction with the axis rotatably supported, the rotation of which makes the developer stirred and carried in the axial direction (the direction toward the lower side from the upper side in FIG. 2) to supply the developer to the whole area of the developer carrying member 24 in the axial direction.

In the developer stirring unit 23, provided are two developer stirring sections 26 and 27 disposed side by side in the front-and-rear direction with facing each other and extending in the axial direction with the respective axis rotatably supported.

The housing 20 has a projecting portion 20A projecting outwardly in the axial direction from one end of the developer carrying member 24, and a toner supplying opening 20C for supplying unused toner (hereinafter "new toner") from a toner replenishing mechanism (not shown) to the developer stirring unit 23, the toner supplying opening 20C being formed on a top plate 20B in the projecting portion 20A, located above a position where two developer stirring sections 26 and 27 face each other.

The toner replenishing mechanism has a function to supply the new toner according to the amount of toner consumed in the development, so that the toner density in the developer is kept even.

The developer carrying member 24 is, for example, provided rotationally and is composed of a developing sleeve made of nonmagnetic material such as aluminum or the like and a developing magnet made of a plurality of bar-like magnet members comprising, for example, a plurality of magnetic poles fixedly placed within the development sleeve.

Preferably, the developer supplying/collecting section 25 is rotated at a position where the developer carrying member 24 and the developer supplying/collecting section 25 face each other so as to be moved in a direction opposite to the developer carrying member 24. Thereby, since it is possible to securely exchange between the developer supplied from the developer supplying/collecting section 25 to the developer carrying menber 24 and the developer collected by the developer supplying/collecting section 25 after the toner is consumed on the developer carrying member, 24 toner density of the developer on the developer carrying member 24 becomes even. As a result, it is possible to securely prevent image density unevenness from occurring.

One developer stirring section (hereinafter, "first developer stirring section) 26 out of the two developer stirring sections placed in the developer stirring unit 23 is to carry the developer in a direction opposite to the developer supplying/collecting section 25 while stirring the developer, and has developer carrying capability equal to that of the developer supplying/collecting section 25.

Concretely, the first developer stirring section 26 has the same structure as the developer supplying/collecting section 25 (see FIG. 5), is composed of a screw-like rotating member 32 having a stirring member 31 made of a spiral blade member so as to extend spirally throughout the outer periphery of a shaft member 30 by pitch p, and has a paddle-like shape where a plurality of plate-like blade members (not shown) are placed on the outer periphery of the shaft member so as to extend in a radial direction at an edge part of downstream side in the developer carrying direction.

The other developer stirring section (hereinafter, "second developer stirring section") 27 placed in the developer stirring unit 23 has substantially no developer carrying capability in the axial direction and higher developer stirring capability than the developer stirring section 26.

Figure 6:
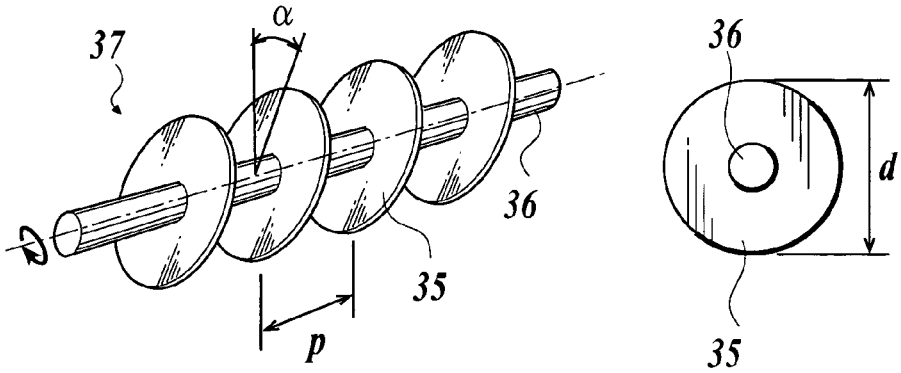
FIG. 6 is a plain view showing one structure example of a rotating member structuring a second developer stirring section in the first to third embodiments according to the present invention.

Concretely, the second developer stirring section 27 is, for example, as shown in FIG. 6, is composed of a paddle-like rotating member 37 where a plurality of oval-plate stirring member 35 are arranged with being inclined in the same direction with respect to a shaft member 36 with the shaft member 36 passing through, and each stirring member 35 is arranged, for example, by predetermined size pitch p so as to make interval thereof equal.

Area size where the stirring member 35 is contacted with the developer, a mounting angle α of the stirring member 35 with the shaft member 36, a spaced distance p between the two stirring members 35, 35 located next to each other in the axial direction and other structures can be properly set according to purposes.

It is preferable in this development apparatus that the second developer stirring section 27, which has substantially no developer carrying capability in the axial direction, is disposed in rear side with respect to the developer supplying/collecting unit 22.

Preferably, the first stirring section 26 and the second stirring section 27 are rotated by a proper driving mechanism so that each periphery of the sections 26 and 27 should be moved in forward directions from the upper to the lower at the position where the first and the second stirring section 26 and 27 are facing each other in the developer stirring unit 23.

In the development apparatus shown in figures, the first and second developer stirring sections 26 and 27 are interlocked with each other.

This development apparatus uses two-component developer composed of toner and carrier.

The toner in the two-component developer preferably has a volume-average particle diameter of 3 μm to 5 μm. The use of small-size toner having the particle diameter of 3 μm to 5 μm makes it possible to steadily form toner images with high resolution and excellent reproducibility of thin lines as well as with stable image density in solid portions.

Denoting the volume-average particle diameter of the toner by Dt (μm), it is preferable that the carrier has a volume-average particle diameter of 5×Dt to 10×Dt (μm). When carrier having volume-average particle diameter fifth to tenth time as large as that of the toner is used, electrostatic charging capability to be imparted on the surface of the carrier can be improved even if small-size toner is used. This use of carrier securely prevents the occurrence of toner fog and blurring, and therefore it is possible to steadily obtain excellent images with fine and even image density.

In the image formation apparatus as described above, the development process by the toner image forming section 8 is carried out in the state to meet the following operational conditions (1) and (2), $$W \geqq M \times V \times L/1000 \qquad \text{Condition (1)}$$

$$R \leqq 600 \qquad \text{Condition (2)}$$

where V represents the peripheral speed (mm/sec) of the latent image carrying member 2, M represents the maximum toner amount attaching to one unit area in the toner image formed on the latent image carrying member 2 (mg/cm$^2$), L represents the maximum width (mm) of the toner image formed on the latent image carrying member 2 in a direction (axial direction) perpendicular to the moving direction of the latent image carrying member 2, W represents the developer carrying amount (g/sec) in the axial direction by the developer supplying/collecting section 25, and R represents the rotation number of the supplying/collecting section 25.

If the developer carrying amount W in the axial direction by the developer supplying/collecting section 25 is too small, the toner density in the developer, at the developer supplying region of the downstream in the developer carrying direction of the supplying/collecting section 25, becomes lower, and the toner is not sufficiently supplied to the development area, and thereby uneven image density easily occurs. If the rotation speed R of the developer supplying/collecting section 25 is too high, the shaft portion gets heated, and thereby the developer easily gets deteriorated, which ends up to be difficult to form high quality images.

The image forming operation in the above-described image formation apparatus is executed as follows.

In each of the toner image forming units 1Y, 1M, 1C and 1K, an electrostatic latent image corresponding to a document image is formed on the latent image carrying member 2 by a charging process by the charging section 3 and an exposure process by the exposing section 4. Then, by a development process by the toner image forming section 8, color toner images are formed on each latent image carrying member 2.

In more detail, at the time of the development process of the electrostatic latent image performed by the toner image forming section 8, in the developer stirring unit 23, while the first developer stirring section 26 stirs the developer in the axial direction, the first and second developer stirring sections 26 and 27 stir and mix the developer, and thereby the developer is introduced into the developer supplying/collecting unit 22 with the toner charged up to a predetermined amount by friction. In the developer supplying/collecting unit 22, the developer is carried in the axial direction while the developer supplying/collecting section 25 stirs the developer in the peripheral direction, and the developer is supplied to whole the surface of the developer carrying member 24 in the axial direction, and thereby the developer carrying member 24 bears the toner thereon as magnetic brush. Then, a developer regulating member 28 regulates the heads of the magnetic brush to a proper height to feed the toner to the development region. When the magnetic brush is contacted with the surface of the latent image carrying member 2, the toner adheres according to the latent image formed on the latent image carrying member 2, and then a toner image is formed.

The developer supplied to the developer carrying member 24, after the toner is consumed at the development area, is carried toward the developer stirring unit 23 by the supplying/collecting section 25 along with the remaining developer at the developer supplying/collecting unit 22 without being supplied to the developer carrying member 24. Thereafter, the new toner is replenished to the developer stirring unit 23 by the toner replenishing mechanism according to the toner consumption, for example, based on toner density detected by a toner density sensor which senses the magnetic permeability of the developer, provided at the downstream side of the supplying/collecting unit 22.

Then, color toner images are sequentially primary-transferred on the intermediate transferring belt 9 by the primary transferring mechanism 5 so as to be overlaid on the transferring belt 9 to form a color toner image. This color toner image generated on the transferring belt 9 is carried to a secondary transferring area while being kept by the intermediate transferring belt 9, and secondary-transferred on a transferring material P fed by the secondary transferring mechanism 7. Thereafter, a fixing process is applied by fixing section (not shown), and then a visible image is formed.

According to the image formation apparatus having the above-described structure, developer carrying speed is balanced by circularly carrying the developer in the toner image forming section 8 with the use of the first stirring section 26 and the developer supplying/collecting section 25 (having equal developer carrying capability to each other), and electrostatic charging of the toner is performed by stirring the developer in the circumferential direction with the use of the second developer stirring section 27 having no developer carrying capability in the axial direction. Thereby, while the first developer stirring section 26 carries the developer in the axial direction, since it is possible to have sufficient mixing and stirring time without reducing the developer carrying speed in the developer stirring unit 23, substantially, the toner is charged up to a predetermined amount by the mixing and stirring operation of the developer in the developer stirring unit 23, and supplied to the developer carrying member 24 by the developer supplying/collecting section 25 with even toner density in the axial direction.

Concretely, at the position where the first and the second developer stirring section 26 and 27 face each other, exchange between the developer existing in a stirring region by the first developer stirring section 26 and the developer existing in a stirring region by the second developer stirring section 27 is repeatedly performed when the developer moves in the axial direction as much as a certain distance, and, after the developer spread in the stirring region by the second developer stirring section 27 is stirred in the circumferential direction without being carried in the axial direction, the developer is brought back to the stirring region by the first developer stirring section 26 to be carried in the axial direction. Therefore, the developer introduced from the developer stirring unit 23 to the developer supplying/collecting section 22 is in the state of being charged up to a predetermined electrostatic charging amount.

Therefore, since the latent image on the latent image carrying member 2 is developed in the state that the developer charged up to a predetermined amount is supplied to the developer carrying member 24 with even toner density in the axial direction, it is possible to securely prevent the occurrence of toner fog and toner bluring due to insufficient charging of the toner, as well as to prevent uneven image density in the obtained visible image, and thereby it is possible to steadily obtain high quality images with well-regulated image density and color balance.

If a rotating member having high toner stirring capability is simply employed as a developer stirring section, it is difficult to have the toner charged up to predetermined amount rapidly (to have a steeply rising charging characteristic). On the other hand, according to the above-described development apparatus, the first and second developer stirring sections 26 and 27 are rotated so that each periphery should move in the forward directions to each other from the upper side to the lower side at the point where both the sections 26 and 27 face each other, and the toner is supplied to the facing point from the upper side (toner falls under gravity). Therefore, since the replenished toner is sunk with acceleration into the developer at the toner replenishing point, and dispersed evenly into the developer, it is possible to securely charge the toner up to the predetermined amount at the developer stirring section in the developer stirring unit.

Further, since the development process is performed so as to satisfy the specific conditions (1) and (2), which are presented beforehand, the developer can be supplied to the development region without having uneven toner density in the axial direction, that is, with having extremely little toner density difference in the axial direction, to thereby obtain images having even image density. Additionally, since the rotation speed R of the toner supplying/collecting section 25 is set to not more than 600 rpm (condition (2)), the toner deterioration can be securely prevented without getting the shaft portion heated due to high speed rotation of the developer supplying/collecting section 25.

As mentioned, according to the image formation apparatus as described above, even if toner consumption is very large and the toner is replenished repeatedly due to continuously outputting images having high dot area percent, it is possible to sufficiently mix and stir toner and carrier, to obtain sufficient toner charge rising characteristic, and to further supply the developer to the development region with even toner density in the axial direction. Therefore, even if high speed image forming operation, for example, with a process speed of more than 50 sheets per minute, is required, even density images can be steadily formed without toner fog nor toner blurring in addition to uneven image density.

Further, since the second developer stirring section 27 having lower developer carrying capability is provided at a rear side with respect to the supplying/collecting unit 22, it is possible to securely prevent the developer from stagnating near the passage between the developer supplying/collecting unit 22 and the developer stirring unit 23, to thereby circulate the developer smoothly. With this structure, the developer can be supplied to the developer carrying member 24 with even toner density in the axial direction, and thereby it is possible to form high quality images without uneven image density.

As above, one preferred embodiment of the present invention has been explained. However, the first and second developer stirring sections 26 and 27 provided within the developer stirring unit 23 are not limited to the structure described above. Other structure may practically attain sufficient result, as long as the first developer stirring section 26 has developer carrying capability in the axial direction equal to that of the developer supplying/collection section 25, and the second developer stirring section 27 has substantially no developer carrying capability in the axial direction.

Figure 7:
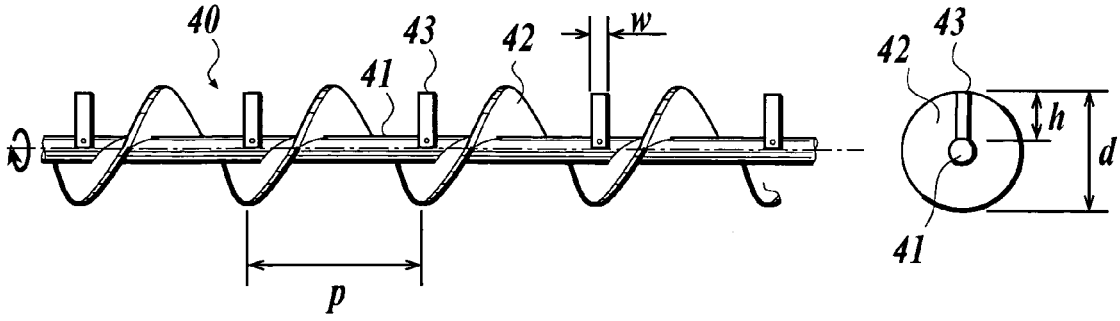
FIG. 7 is a pattern diagram showing one structure example of the rotating member structuring a developer stirring section in the first to third embodiments according to the present invention.
Figure 8:
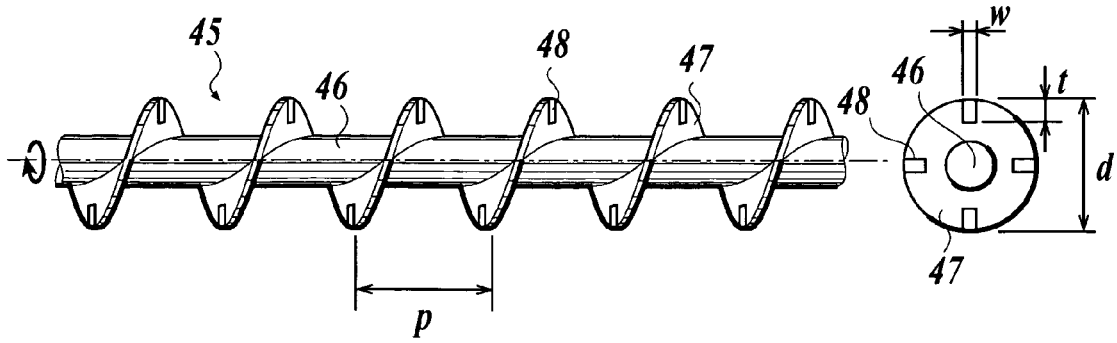
FIG. 8 is a pattern diagram showing one structure example of the rotating member structuring the developer stirring section in the first to third embodiments according to the present invention.
Figure 9:
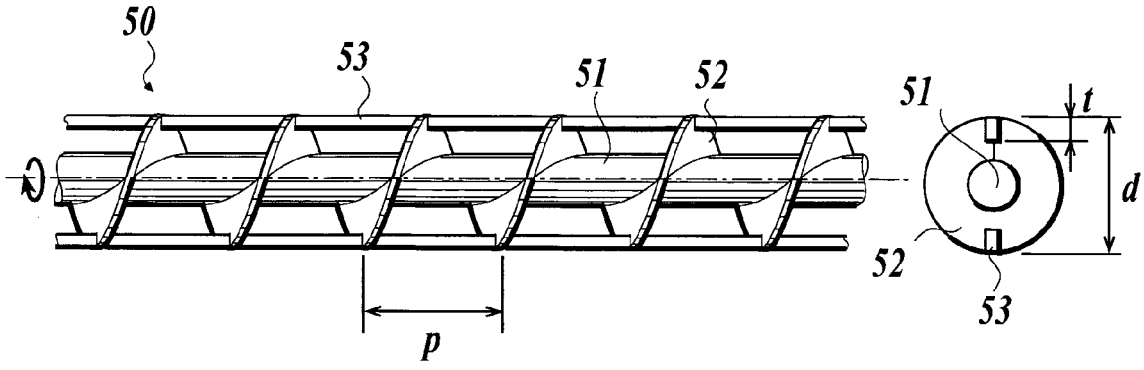
FIG. 9 is a pattern diagram showing one structure example of the rotating member structuring the first and second developer stirring sections in the first to third embodiments according to the present invention.

For instance, the first and second developer stirring sections 26 and 27 may have structures as shown in FIGS. 7 to 9.

Concretely, rotating members 40, 45 and 50 shown in FIGS. 7 to 9 respectively have enough developer carrying capability to prevent uneven toner density in the axial direction from occurring, and have high developer stirring capability.

A rotating member 40 shown in FIG. 7 includes a main stirring member 42 and auxiliary stirring members 43. The main stirring member 42 are spiral blade members spirally extending throughout the outer periphery of a shaft member 41 in the axial direction and are arranged by a predetermined pitch p. Each auxiliary stirring member 43 is a bar-like or plate-like vertical blade member extending outwardly in a radial direction from the shaft member 41 and arranged in the center of the screw pitch p of the main stirring member 42 in this example.

A rotating member 45 shown in FIG. 8 has a stirring member 47 that is a spiral blade member spirally extending throughout the outer periphery of a shaft member 46 in the axial direction by a predetermined pitch p, and the stirring member 47 has notch member 48, which is formed on the circumferential edge of the stirring member 47 and arranged so as to pass through in the axial direction. In this example, the notch members 48 are formed by four positions per one screw pitch with even interval along the circumferential direction.

A rotating member 50 shown in FIG. 9 includes a main stirring member 52 and rib members 53. The main stirring member 52 is formed so as to spirally extend throughout the outer periphery of a shaft member 51 in the axial direction by a predetermined pitch p. The rib members 53 are in a plate-like shape and are provided on the circumferential edge of the main stirring member 52 so as to extend in the axial direction. In this example, the two rib members 53 are arranged at a position where the two face each other with respect to the shaft member 51.

According to the development apparatus having the first developer stirring section 26 composed of any one of the above-mentioned rotating members 40, 45 and 50, basically, it is possible to obtain sufficient developer carrying speed, to prevent uneven toner density of the developer supplied to the developer carrying member in the axial direction, and further to more securely obtain sufficient charge rising characteristic. As a result, it is possible to securely prevent a problem such as toner bluring, toner fog, uneven image density and the like, from occurring.

Figure 10:
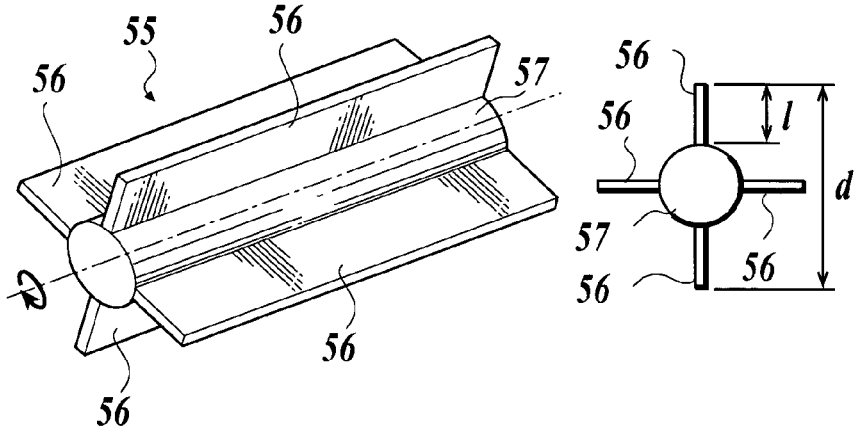
FIG. 10 is a pattern diagram showing one structure example of the rotating member structuring the developer stirring section according to the present invention.

Further, the second developer stirring section 27 may be, as shown in FIG. 10 for example, composed of a cross-paddle-like rotating member 55 having four plate-like rib member 56, 56, 56, 56 arranged on the outer periphery of a shaft member 57 with equal space secured between in the circumferential direction so as to extend in the external radial direction.

In the present invention, at least the second developer stirring section 27 is, in view of securely obtaining sufficient charge rising characteristic, more preferably one having higher developer carrying capability.

Figure 11:
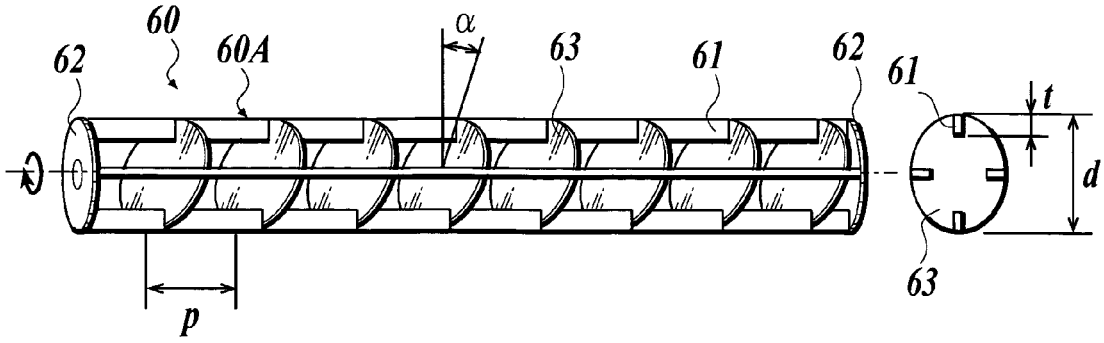
FIG. 11 is a pattern diagram showing one structure example of the rotating member structuring the developer stirring section in the first embodiment according to the present invention.
Figure 12:
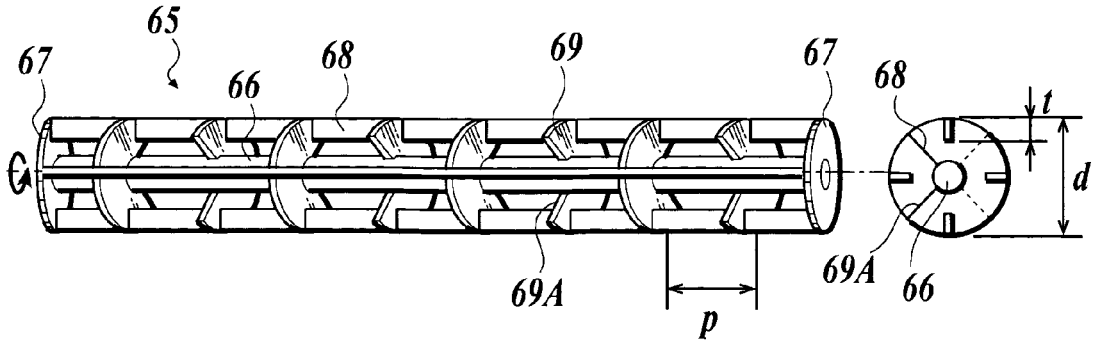
FIG. 12 is a pattern diagram showing one structure example of the rotating member structuring the developer stirring section in the first embodiment according to the present invention.

FIGS. 11 and 12 are perspective views showing more preferable examples of rotating members used as the second developer stirring sections 27.

A rotating member 60 shown in FIG. 11 includes a frame 60A where a plurality (for example, four) of plate-like rib members 61 extending in the axial direction in parallel have their edges fixed with disc-like flange members 62, 62, and the rotating member 60 has a structure where a plurality of oval-plate stirring members 63 inclined in the same direction to each other with respect to the rotation center axis of the frame 60A are supported by the rib members 61. Each of the stirring members 63 are placed by a predetermined equal interval pitch p.

In regard to the rotating member 60, a shaft member (not shown) extending outwardly in the axial direction is placed on each of the flange members 62 and 62 so that the housing 20 of the development apparatus could rotatably bear the rotating member 60, and by rotating the rotating member 60 around the shaft member, while the developer in the developer stirring section 63 is carried in the axial direction by the first developer stirring section 27, the semioval stirring members 63 functioning as main stirring members stir the developer in the circumferential direction and the rib members 61 functioning as auxiliary stirring members stir the developer in the circumferential direction.

The rotating member 65 as shown in FIG. 12 includes a shaft member 66 extending in a rotation shaft direction, two of disc-like flange members 67 and 67 supporting the shaft member 66, plate-like rib members 68 extending in the axial direction along the shaft member 66, the rib member 68 placed fixedly with the flange members 67 and 67, and a plurality of plate-like main stirring members 69 supported by the rib member 68 with the shaft member 66 passing through along a plane perpendicular to the shaft member 66.

Each of the main stirring members 69 has a disc-like shape having a notch member 69A having a predetermined size of the central angle. The notch members 69A are arranged by a predetermined size equal pitch p in the axial direction so as to respectively locate the notch members 69A and 69A in two main stirring members 69 and 69 located next to each other at periphery positions opposed to each other with respect to the shaft member 66.

In the case of the second developer stirring member 27 composed of any one of the above-described rotating members 60 and 67, a size of an area where the main stirring members 63 and 69 are in contact with the developer, an interval distance (pitch) p between the two main stirring members located next to each other in the axial direction, a size of an area where the rib members 61 and 68 are in contact with the developer and other structures may be properly set according to purposes.

According to the development apparatus with the second developer stirring section 27 composed of the rotating members 60 and 65 having the above-described auxiliary stirring members 61 and 68, the aforementioned actions and effects can be more securely obtained, that is, it is possible not only to securely prevent toner fog and toner blurring due to insufficient charging of toner, but also to prevent uneven image density due to uneven toner density of the developer supplied to the developer carrying member in the axial direction.

Therefore, according to the image formation apparatus using such development apparatus, since the latent image on the latent image carrying member 2 is developed in the state that the developer having desired charging amount with sufficient stirring is supplied to the developer carrying member 24 with even toner density in the axial direction, it is possible to securely prevent the occurrence of defection such as toner blurring, fog and uneven image density, whereby high quality images can be steadily obtained.

Given above is description of an image formation apparatus having a plurality of toner image forming units for forming color images, but the present invention is not limited to such an apparatus, and is effectively applicable to various structures. For instance, the present invention may be applied to an image formation apparatus for forming monochromatic images without reducing the actions and effects described above.

Next, as another example of an image formation apparatus according to the present invention, an image formation apparatus having a toner recycling section for collecting toner which is removed by the latent image carrying member cleaning section to be reused will be described.

Figure 13:
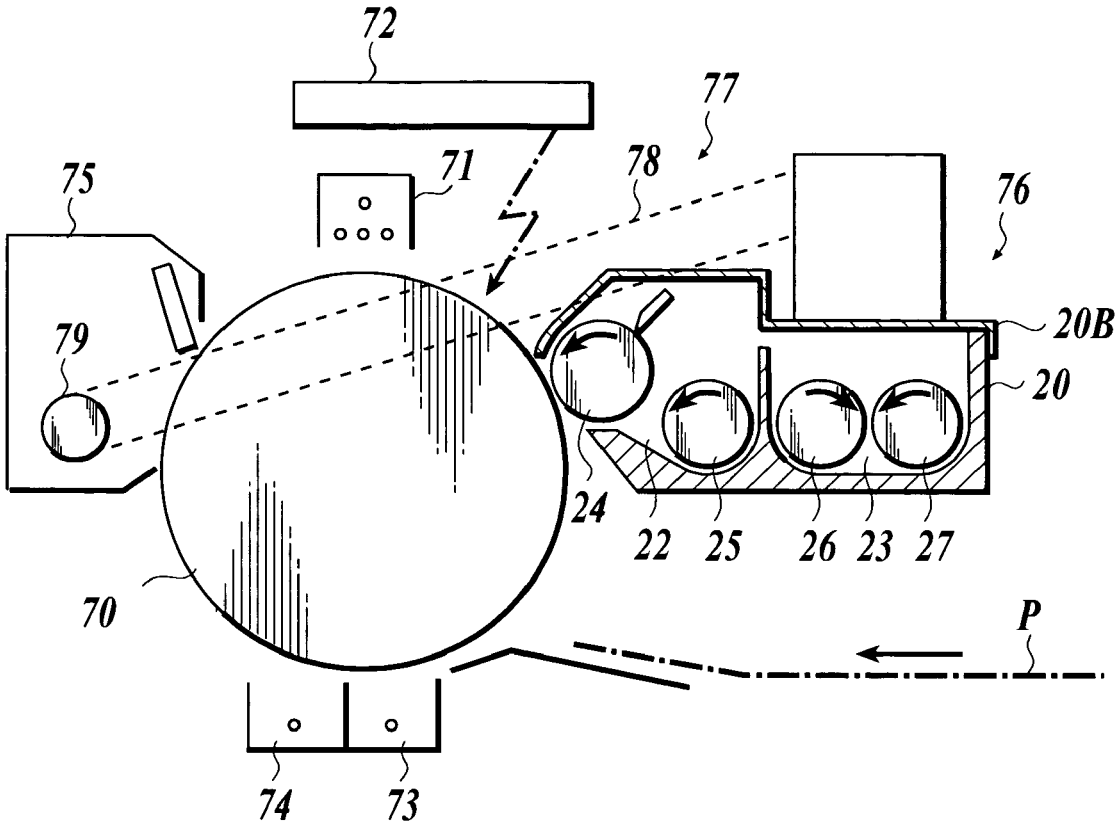
FIG. 13 is a pattern diagram showing another example of a rough structure of an image formation apparatus according to the present invention.

FIG. 13 is a schematic illustration showing the construction of the image formation apparatus according to the present invention. This image formation apparatus includes a rotating drum-type latent image carrying member 70, and also a charging section 71, an exposing section 72, a toner image forming section 76, a transferring section 73, a separation section 74 and a latent image carrying member cleaning section 75, and these section are arranged in an operational order in a rotating direction along the outer periphery of the latent image carrying member 70. The apparatus further includes a toner recycling section 77 having a collecting/carrying section 78 that collects the toner removed from the latent image carrying member 70 by the latent image carrying member cleaning section 75 and supplies it to the toner image forming section 76. Numeral 79 in FIG. 13 denotes a carrying section for carrying the toner scratched off from the latent image carrying member 70 by the latent image carrying member cleaning section 75, in an axial direction of the latent image carrying member 70.

The toner image forming section 76 in this apparatus is, for example, in view of a basic structure, approximately the same as toner image forming section 8 as shown in FIGS. 2 to 4. The toner image forming section 76 has a recycled toner mixing opening 29 formed on the top plate 20B in the projecting portion 20A of the housing 20 for mixing the toner collected by the recycle section 75 (hereinafter "recycled toner") into the developer stirring unit 23, the recycled toner recycled toner mixing opening 29 located at upstream of the toner supplying opening 20C in the developer carrying direction and above the position where the first and second developer stirring sections 26 and 27 face each other.

The position of the recycled toner recycled toner mixing opening 29 is not particularly limited as long as it is formed so as to meet a forming position of the toner supplying opening 20C for new toner by the toner supplying mechanism with respect to the developer carrying direction in the developer stirring unit 23 and predetermined order, but it is practically preferable to form the recycled toner recycled toner mixing opening 29 at 5 to 30 mm further upstream side than the supplying opening 20C in the developer carrying direction.

The recycled toner is supplied to the developer stirring unit 23 so as to be mixed therein and maintain the ratio thereof with respect to new toner (recycled toner ratio) at not more than 50 wt %.

According to the development apparatus having the above-mentioned structure, when the developer is carried in the axial direction within the developer stirring unit 23, it is possible to have sufficient mixing and stirring time without reducing the developer carrying speed, whereby the toner is charged up to predetermined amount (electrostatic amount) by the mixing and stirring operation of the developer, and supplied to the developer carrying member 24 by the developer supplying/collecting section 25 with even toner density in the axial direction. Furthermore, since the recycled toner mixing opening 29 is positioned at upstream side of the supplying opening 20C, in regard to recycled toner, which has lower flowability and electrostatic chargeability (difficult to be charged) than new toner, it is possible to secure longer mixing and stirring time to obtain sufficient charge rising characteristic, and thereby it is possible to securely prevent occurrence of toner fog and blurring as well as uneven image density on a visible image due to insufficient toner charging.

Therefore, according to the image formation apparatus comprising such a development apparatus, even if toner consumption is very large and the toner, including recycled toner, is replenished repeatedly due to continuously outputting images having high dot area percent, it is possible to sufficiently stir toner and carrier, obtain sufficient toner charge rising characteristic, and further supply the developer to the development region with even toner density in the axial direction. Therefore, even if high speed image forming operation, for example, with a process speed of not less than 50 sheets per minute, is required, high quality images with even density images can be steadily formed without toner fog nor toner blurring in addition to uneven image density.

Further, for instance, the particular structural elements of rotating members used in the developer supplying/collecting section, the first and second developer stirring sections, the pitch size of each spiral blade member, the shape and size of each auxiliary stirring member, the rotational speed of the rotating member (the developer carrying speed in the axial direction), etc. can be properly set according to their purposes.

Further, the first and second developer stirring sections may be rotated independently of each other by respective driving mechanisms.

Second Embodiment

Next, a second embodiment of the present invention will be described. Here, the second embodiment of the present invention adopts the same structure as the first embodiment except for the development apparatus 19 shown in FIG. 2.

Hereinafter, with reference to FIGS. 14, 3 and 4, the development apparatus in the second embodiment will be described.

Figure 14:
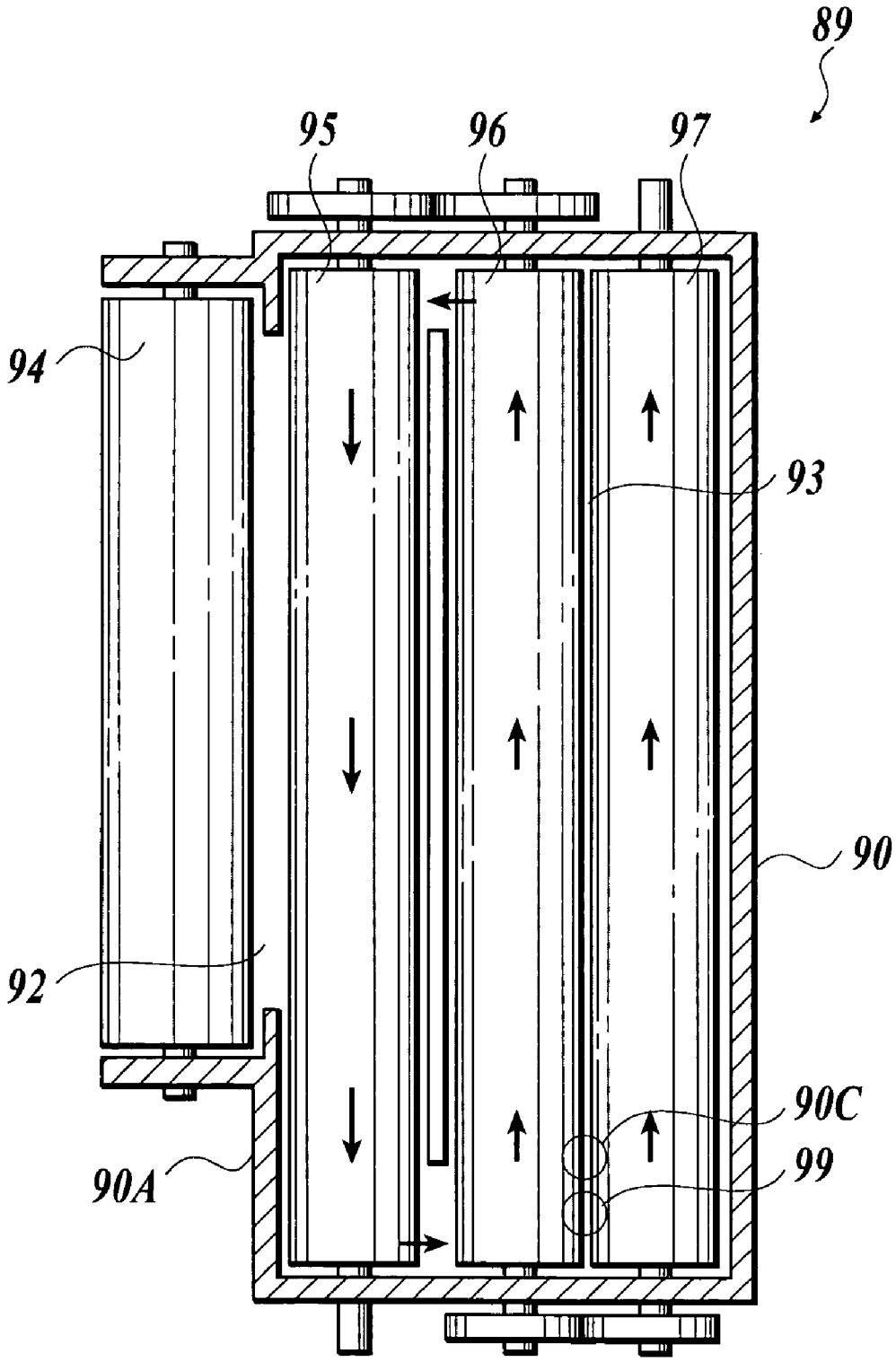
FIG. 14 is a partial cross-sectional pattern diagram showing a rough structure of a development apparatus in the second embodiment according to the present invention.

FIG. 14 is a vertical cross-sectional schematic view showing a development apparatus according to the present invention.

Figure 5:
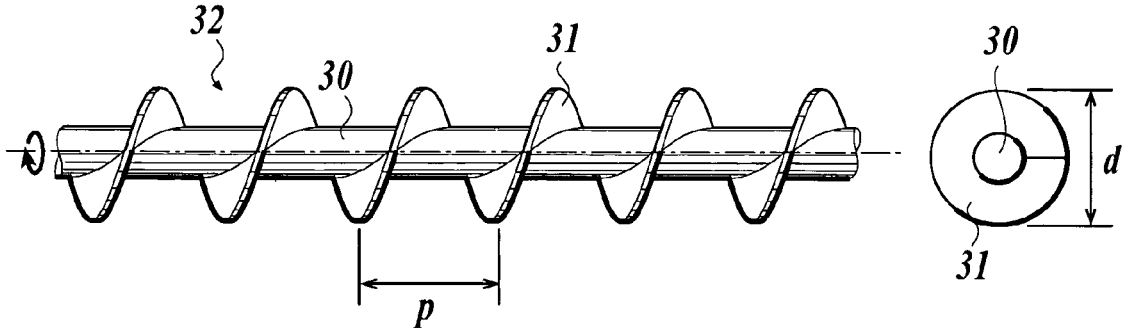
FIG. 5 is a pattern diagram showing one structure example of a rotating member structuring a developer supplying/collecting section and a first developer stirring section in the first to third embodiments according to the present invention.

The developer supplying/collecting section 95 is, for example, a screw-like rotating member 32 having, as shown in FIG. 5, a stirring member 31 made of a spiral blade member spirally extending in the axial direction throughout the whole outer circumference of a shaft member 30 by a even-sized pitch p, and has a paddle part composed of plate-like blade members (not shown) mounted on the outer circumference of the shaft member 30 at the downstream end portion in a developer carrying direction (lower end portion in FIG. 14).

Both the two developer stirring sections 96 and 97 in the developer stirring member 93 carry the developer in opposite directions to the developer supplying/collecting section 95, and total amount of developer carried by both the developer stirring sections 96 and 97 are equal to the developer amount carried by the supplying/collecting section 95.

One of the developer stirring section (hereinafter "first developer stirring section") 96 has a lower developer carrying capability in the axial direction than that of the supplying/collecting section 95.

In more detail, the first developer stirring section 96 has basically, for example, the same structure as that of the supplying/collecting section 95 (see FIG. 5), that is, a screw-like rotating member 32 having a stirring member 31 made of a spiral blade member spirally extending in the axial direction throughout the whole outer circumference of a shaft member 30 by a predetermined pitch p1, and has a paddle part composed of a plurality of plate-type blade members extending outwardly in a radial direction (not shown) mounted on the outer circumference of the shaft member 30 at the downstream end portion in the developer carrying direction (upper end portion in FIG. 14). In this case, the pitch p1 is set smaller than the pitch p of the supplying/collecting section 55, so that the developer carrying capability thereof in the axial direction should be lower than that of the supplying/collecting section 95.

It is preferable that the other developer stirring section (hereinafter "second developer stirring section") 97 within the developer stirring unit 93 has developer carrying capability equal to or lower than that of the first developer stirring section 96.

Figure 15:
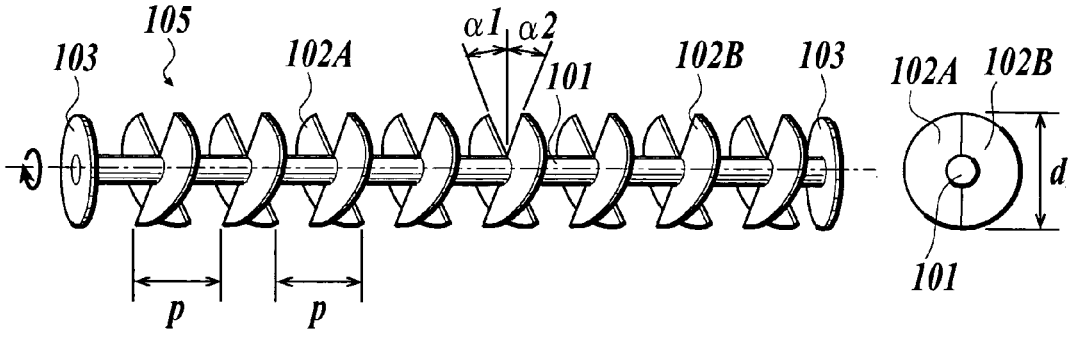
FIG. 15 is a pattern diagram showing a structure of a rotating member structuring a second developer stirring section in the second embodiment according to the present invention.

In more detail, as shown in FIG. 15, the second developer stirring section 97 has a rotating member 105 having a first stirring member 102A group and a second stirring member 102B group each mounted on the outer periphery of a shaft member 101, each of the member 102A and 102B groups having a plurality of half-oval plates provided along respectively first and second stirring-member arranging-level planes inclined in different directions each other with respect to planes orthogonal to the shaft member 101. The first and second stirring members 102A and 102B are, respectively, arranged apart by a predetermined pitch p in the axial direction.

A mounting angle $\alpha 1$ of the first member 102A group with the shaft member 101 and a mounting angle $\alpha 2$ of the second member 102B group may have sizes equal to or different from each other, and the angles $\alpha 1$ and $\alpha 2$ can be properly set according to purposes.

It is preferable in this development apparatus that the second developer stirring section 97, which has lower developer carrying capability in the axial direction, is disposed in rear side with respect to the developer supplying/collecting unit 92.

Preferably, the first stirring section 96 and the second stirring section 97 are rotated by a proper driving mechanism so that each periphery of the sections 96 and 97 should be moved in forward directions to each other from the upper to the lower at the position where the first and the second stirring section 96 and 97 face each other in the developer stirring unit 93.

In the development apparatus shown in figures, the first and second developer stirring sections 96 and 97 are interlocked with each other.

Therefore, according to the image formation apparatus having the same structure as the first embodiment except for having the development apparatus with the above-mentioned structure, developer carrying speed is balanced by circularly carrying the developer in the toner image forming section 8 with the use of the first developer stirring section 96, the second developer stirring section 97 and the developer supplying/collecting section 95 (the former two sections have developer carrying capability equal to the latter one), and electrostatic charging of the toner is performed by stirring the developer in the circumferential direction with the use of both the first developer stirring section 96 and the second developer stirring section 97. Thereby, while the developer is carried in the axial direction, since it is possible to have sufficient mixing and stirring time without reducing the developer carrying speed in the developer stirring unit 93, the toner is charged up to a predetermined amount by the mixing and stirring operation of the developer in the developer stirring unit 93, and supplied to the developer carrying member 94 by the developer supplying/collecting section 95 with even toner density in the axial direction.

Therefore, since the latent image on the latent image carrying member 2 is developed in the state that the developer charged up to a predetermined amount is supplied to the developer carrying member 94 with even toner density in the axial direction, it is possible to securely prevent the occurrence of toner fog and toner blurring due to insufficient charging of the toner, as well as to prevent uneven image density in the obtained visible image, and thereby it is possible to steadily obtain high quality images with well-regulated image density and color balance.

Further, since the second developer stirring section 97 is structured to have higher developer carrying capability than the first developer stirring section 96, it is possible to securely obtain the aforementioned effects.

As above, the second embodiment of the present invention has been explained. However, the first and second developer stirring sections 96 and 97 provided within the developer stirring unit 93 are not limited to the structure described above. Other structure may practically attain sufficient result, as long as set developer carrying capability in the axial direction meets the relationship with the developer supplying/collecting section, and the developer carrying capability and the developer stirring capability meet the given relationship between the sections.

Figure 16:
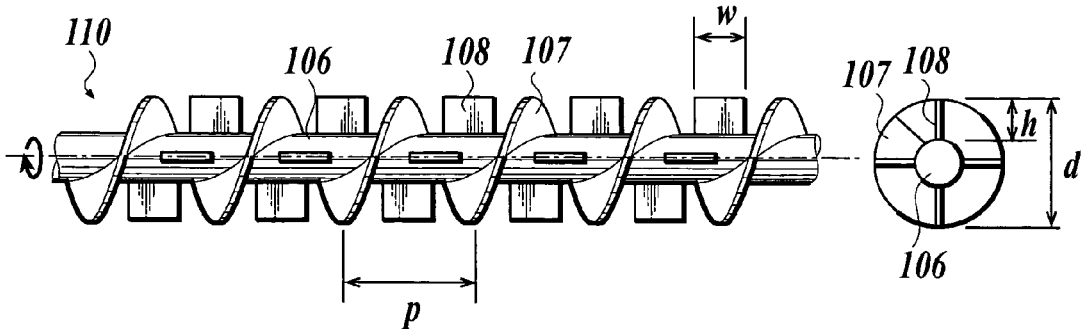
FIG. 16 is a pattern diagram showing a structure of the rotating member structuring the second developer stirring section in the second embodiment according to the present invention.

For instance, the first and second developer stirring sections 96 and 97 may have structures as shown in FIGS. 7, 8 and 16.

In view of a basic structure, any of rotating members shown in FIGS. 7, 8 and 16 is approximately the same as the rotating member having a spiral screw-like member as shown in FIG. 5, but has higher developer stirring capability than that of FIG. 5.

Here, the rotating members shown in FIGS. 7 and 8 are described in the above-mentioned first embodiment, and therefore the description thereof is omitted. The rotating member shown in FIG. 16 will only be described.

A rotating member 110 shown in FIG. 16 includes a main stirring member 107 and a plurality of auxiliary stirring members 108. The main stirring member 107 is a spiral blade member spirally extending throughout the outer periphery of a shaft member 106 in the axial direction by a predetermined pitch p. Each auxiliary stirring member 108 is a bar-like or plate-like vertical blade member extending outwardly in a radial direction from the shaft member 106, and plural blades (for example, four) are arranged with even interval in a circumferential direction within the screw pitch p of the main stirring member 106.

It is more preferable in the present invention that the first and second developer stirring sections 96 and 97 have higher developer stirring capability, in view of obtaining more sufficient toner charge rising characteristic.

Figure 17:
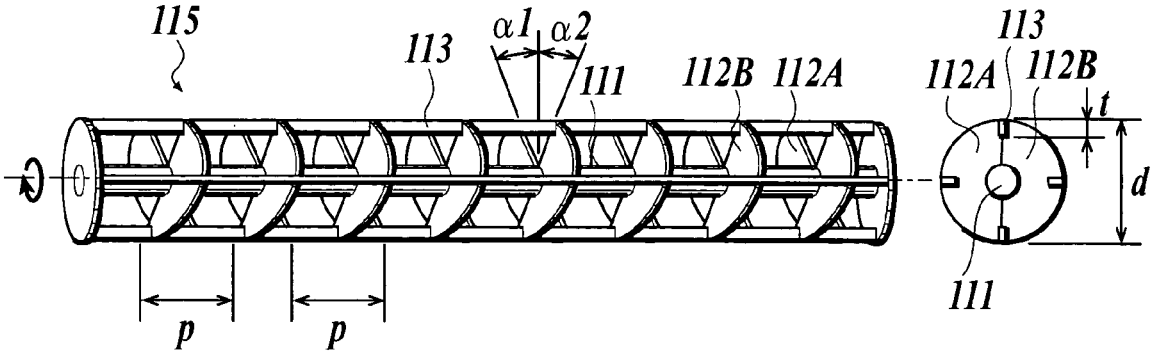
FIG. 17 is a pattern diagram showing a structure of a rotating member structuring the second developer stirring section in the second embodiment according to the present invention.

FIGS. 9 and 17 are perspective views showing examples of more preferable rotating members to be used as the developer stirring sections 96 and 97.

Here, the rotating member 50 shown in FIG. 9 is described in the above-mentioned first embodiment, the description thereof is omitted. Hereafter, rotating member shown in FIG. 17 will only be described.

A rotating member 115 shown in FIG. 17 is, in view of a basic structure, approximately the same as the rotating member 105 shown in FIG. 15. The rotating member 115 has rib members 113 that are plate-like rib members provided on the circumferential edge of semioval first and second stirring members 112A and 112B so as to extend along a shaft member 111 in the axial direction.

In the rotating member 115, four rib members 113 are arranged apart from each other with equal intervals in the circumferential direction.

The rotation of these rotating members 50 and 115 around the respective shaft members 51 and 111 makes the developer within the developer stirring unit 93 carried in the axial direction, and simultaneously being stirred in the circumferential direction by the main stirring members as well as the auxiliary stirring members, namely rib members 53 and 113.

According to the development apparatus with the developer stirring section composed of the rotating members 50 and 115 having the above-described rib members 53 and 113, the aforementioned actions and effects can be more securely obtained, that is, it is possible not only to securely prevent toner fog and toner blurring due to insufficient charging of toner, but also to prevent uneven image density due to uneven toner density of the developer supplied to the developer carrying member 94 in the axial direction.

Therefore, according to the image formation apparatus using such development apparatus, since the latent image on the latent image carrying member 2 is developed in the state that the developer having desired charging amount with sufficient stirring is supplied to the developer carrying member 94 with even toner density in the axial direction, it is possible to securely prevent the occurrence of defection such as toner blurring, fog and uneven image density. Further, it is possible to securely obtain high quality images in the image formation apparatus using such development apparatus with the toner recycling section.

Therefore, according to the image formation apparatus using such development apparatus, for example, even if toner consumption is very large and the toner is replenished repeatedly due to continuously outputting images having high dot area percent, it is possible to sufficiently mix and stir toner and carrier, to obtain sufficient toner charge rising characteristic, and to further supply the developer to the development region with even toner density in the axial direction. Therefore, even if high speed image forming operation, for example, with a process speed of more than 50 sheets per minute, is required, even density images can be steadily formed without toner fog nor toner blurring in addition to uneven image density.

Third Embodiment

Next, a third embodiment of the present embodiment will be described. Here, the third embodiment adopts the same structure as the first and second embodiments except for the development apparatuses 19 and 89 shown in FIGS. 2 and 14, respectively.

Hereinafter, with reference to FIGS. 18, 3 and 4, a development apparatus in the third embodiment will be described.

Figure 18:
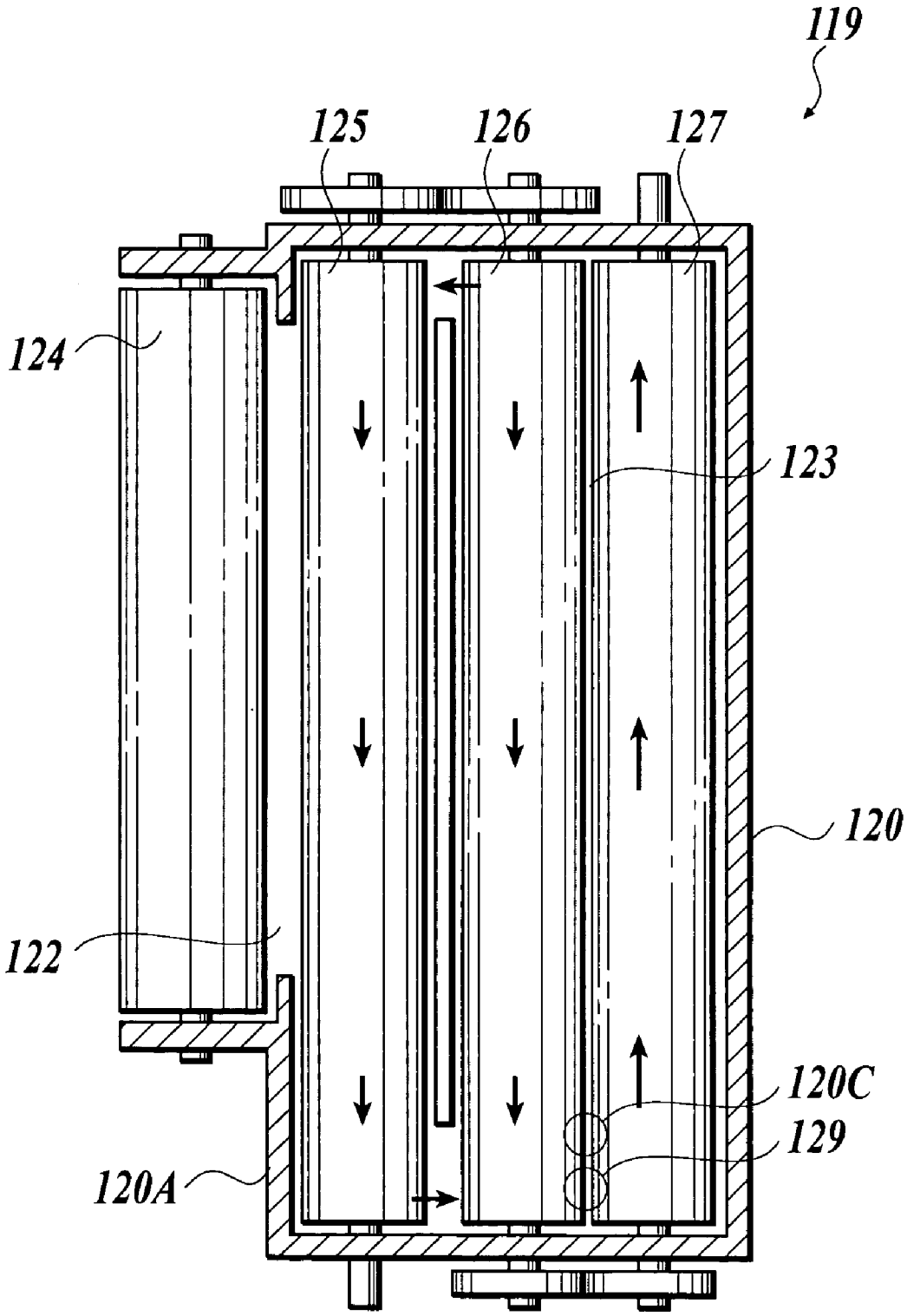
FIG. 18 is a partial cross-sectional pattern diagram showing a rough structure of a development apparatus in the third embodiment according to the present invention.

FIG. 18 is a vertical cross sectional schematic view showing a development apparatus according to the present invention.

The developer supplying/collecting section 125 has the same structure as the above-mentioned first embodiment, and as shown in FIG. 5, a screw-like rotating member 32 having a stirring member 31 made of a spiral blade member spirally extending in the axial direction throughout the whole outer circumference of a shaft member 30 by a even-sized pitch p, and has a paddle part composed of plate-like blade members (not shown) mounted on the outer circumference of the shaft member 30 at the downstream end portion in a developer carrying direction (lower end portion in FIG. 18).

The two developer stirring sections 126 and 127 in the developer stirring section 123 of the development apparatus shown in FIG. 18 carry the toner in opposite directions to each other, in a state where one developer stirring section (hereinafter "first developer stirring section") 126 carries the developer in the same direction with the developer supplying/collecting section 125, and the other developer stirring section (hereinafter "second developer stirring section") 127 carries the developer in a direction opposite to a direction in which the developer supplying/collecting section 125 carries the developer. The second developer stirring section 127 has equal developer carrying capability to that of the total of the developer supplying/collection section 125 and the first developer stirring section 126.

The first developer stirring section 126, as shown in FIG. 15, is composed of a rotating member 105 having a first stirring member 102A group and a second stirring member 102B group, each made of a plurality of half-oval plates placed along each of level planes for locating the first and second stirring members inclined in different directions from each other with respect to the shaft member 101, placed on the periphery of the shaft member 101. The first stirring member 102A and the second stirring member 102B are arranged by a predetermined size screw pitch apart from each other in the axial direction.

A blade angle $\alpha 1$ of the first stirring member 102A group against the shaft member 101 and a blade angle $\alpha 2$ of the second stirring member 102B group against the shaft member 101 may have the same size or different sizes from each other, and the sizes thereof may be properly changed according to purposes.

The second developer stirring section 127, for example, has the same basic structure as the developer supplying/collecting section 25, and is composed of a screw-like rotating member 32 where a spiral blade member is formed on throughout the periphery of a shaft member 31 (see FIG. 5) by a predetermined size pitch p1 in the axial direction so as to extend spirally, and is composed of a paddle-like stuff where a plurality of plate-like blade members (now shown) are placed on the periphery of the shaft member at the edge part of downstream side in the developer carrying direction so as to extend outwardly in the radial direction. In this case, the screw pitch size p1 is set larger than the screw pitch p in the case of the developer supplying/collecting section 125, so that the developer carrying capability by the developer supplying/collecting section 125 should be equal to the total developer carrying capability thereof with the first developer stirring section 126.

Preferably, in this development apparatus, the second developer stirring section 127 having higher developer carrying capability is arranged at a rear side with respect to the developer supplying/collecting unit 122.

Preferably, the first stirring section 126 and the second stirring section 127 are rotated by a proper driving mechanism so that each periphery of the two sections 126 and 127 should be moved in forward directions to each other from the upper to the lower at the position where the first and the second stirring section 126 and 127 face each other in the developer stirring unit 123.

In the development apparatus shown in figures, the first and second developer stirring sections 126 and 127 are interlocked with each other.

Therefore, according to the image formation apparatus having the same structure as the structure in the first or second embodiment except for having the development apparatus 119 with the above-mentioned structure, developer carrying speed is balanced by circularly carrying the developer in the toner image forming section 8 with the use of the first developer stirring section 126, the second developer stirring section 127 and the developer supplying/collecting section 125, and electrostatic charging of the toner is performed by stirring the developer in the circumferential direction with the use of both the first developer stirring section 126 and the second developer stirring section 127. Thereby, while the developer is carried in the axial direction, since it is possible to have sufficient mixing and stirring time without reducing the developer carrying speed in the developer stirring unit 123, the toner is charged up to a predetermined amount by the mixing and stirring operation of the developer in the developer stirring unit 123, and supplied to the developer carrying member 124 by the developer supplying/collecting section 125 with even toner density in the axial direction.

Concretely, since the developer carrying speed is balanced by sharing the developer carrying capability in the axial direction of the second developer stirring section 127, which is structured to have developer carrying capability so as to make circular carrying speed of the developer in the developer apparatus at predetermined amount, with the developer supplying/collecting section 125 and the first developer stirring section 126 having high developer stirring capability, even if the first developer stirring section is structured to have high developer carrying capability and low developer carrying speed, the balance of the carrying speed can be secured. Thereby, it is possible to secure sufficient mixing and stirring time in the developer stirring unit 123 without reducing the developer carrying speed in the entire development apparatus, and the developer introduced from the developer stirring unit 123 to the developer supplying/collecting section 122 is in the state of being charged up to a predetermined charging amount.

Here, in the development apparatus in the present invention, the first developer stirring section 126 and the second developer stirring section 127 placed in the developer stirring unit 123 are not limited to the above-mentioned structure. As long as set developer carrying capability in the axial direction meets the relationship with the developer supplying/collecting section, and the developer carrying capability and the developer stirring capability meet the given relationship between the sections, it is possible to obtain sufficient effect practically.

For instance, the first and second developer stirring sections 126 and 127 may have structures as shown in FIGS. 7, 8 and 16.

Any of rotating members shown in FIGS. 7, 8 and 16 is, in view of a basic structure, approximately the same as rotating member having a spiral screw-like member as shown in FIG. 5, but has higher developer stirring capability than that of FIG. 5.

Here, description of the rotating members 40, 45 and 110 shown in FIGS. 7, 8 and 16 respectively are described in the above-mentioned first and second embodiment, description thereof is omitted.

It is more preferable in the present invention that the developer stirring sections 126 and 127 have higher developer stirring capability in view of obtaining sufficient toner charge rising characteristic.

FIGS. 9 and 17 are perspective views showing more preferable structure examples of rotating members used as the developer stirring sections 126 and 127.

A rotating member 115 shown in FIG. 17 is, in view of a basic structure, approximately the same as the rotating member 105 shown in FIG. 15. The rotating member 115 has rib members 113 that are plate-like rib members provided on the circumferential edge of semioval first and second stirring members 112A and 112B so as to extend along a shaft member 111 in the axial direction.

In the rotating member 115, four rib members 113 are arranged apart from each other with equal intervals in the circumferential direction.

The rotation of these rotating members 50 and 115 around the respective shaft members 51 and 111 makes the developer within the developer stirring unit 123 carried in the axial direction, and simultaneously being stirred in the circumferential direction by the main stirring members as well as the auxiliary stirring members, namely rib members 53 and 113.

According to the development apparatus with the developer stirring section composed of the rotating members 50 and 115 having the above-described rib members 53 and 113, the aforementioned actions and effects can be more securely obtained, that is, it is possible not only to securely prevent toner fog and toner blurring due to insufficient charging of toner, but also to prevent uneven image density due to uneven toner density of the developer supplied to the developer carrying member 124 in the axial direction.

Therefore, according to the image formation apparatus using such development apparatus, since the latent image on the latent image carrying member 2 is developed in the state that the developer having desired charging amount with sufficient stirring is supplied to the developer carrying member 124 with even toner density in the axial direction, it is possible to securely prevent the occurrence of defection such as toner blurring, fog and uneven image density, whereby high quality images can be steadily obtained.

Therefore, according to the image formation apparatus using such development apparatus, for example, even if toner consumption is very large and the toner is replenished repeatedly due to continuously outputting images having high dot area percent, it is possible to sufficiently mix and stir toner and carrier, to obtain sufficient toner charge rising characteristic, and to further supply the developer to the development region with even toner density in the axial direction. Therefore, even if high speed image forming operation, for example, with a process speed of more than 50 sheets per minute, is required, even density images can be steadily formed without toner fog nor toner blurring in addition to uneven image density.

Given above is description of an image formation apparatus having a plurality of toner image forming units for forming color images, and an image formation apparatus having a toner recycling section for forming a monochrome image in the first, second and third embodiments, but the present invention is not limited to such an apparatus, and is effectively applicable to various structures without reducing the actions and effects described above.

EXPERIMENTAL EXAMPLES

According to the above-mentioned first, second and third embodiment, experiments have been conducted. Hereinafter, experimental examples thereof will be described.

Experimental Example 1

<Production of Rotating Members>

In regard to the first embodiment, produced are rotating members (rotating members A, C, E, G, I, J, K, L, M, Q, R, S, T, W and X) to be used as the developer supplying/collecting section 25, and the first and second developer stirring sections 26 and 27.

(Rotating Member A)

A rotating member A is produced according to the structure shown in FIG. 5, wherein a spiral blade member (stirring member) is wound right-upward (counterclockwise) on the outer periphery of a shaft member to form a spiral screw, and at the end area of the downstream side in the developer carrying direction over 30 mm in length, provided is a paddle part having four stirring members of plate-like blades mounted on the outer periphery of the shaft member and extending outwardly in the radial direction. At both the ends of the rotating member A, provided are disc-like flange members, each having an outer diameter of 24 mm with the shaft member passing through. Specific dimensions of the rotating member A are as follows.

Maximum outer diameter (d): 24 mm, axial length except for shaft portion (size of area where the spiral blade member and the plate-like blades are mounted): 440 mm, shaft outer diameter: 6 mm, screw pitch of the spiral blade member (p): 30 mm, thickness of the spiral blade member: 1 mm.

(Rotating Member C)

A rotating member C differs from the rotating member A in that a spiral blade member is wound left-upward (clockwise) on the outer periphery of a shaft member.

(Rotating Member E)

A rotating member E is produced based on the structure shown in FIG. 8, wherein a spiral blade member (stirring member) is wound right-upward (counterclockwise) on the outer periphery of a shaft member and has notches on the circumferential edge to form a spiral screw, and at the end area of the downstream side in the developer carrying direction by 30 mm in length, provided is a paddle part having four stirring members of plate-like blades mounted on the outer periphery of the shaft member and extending outwardly in the radial direction. At both the ends of this rotating member E, provided are disc-like flange members, each having an outer diameter of 24 mm with the shaft member passing through. Specific dimensions of the rotating member E are as follows.

Maximum outer diameter (d): 24 mm, axial length except for shaft portion (size of area where the spiral blade member are mounted): 440 mm, shaft outer diameter: 6 mm, screw pitch of the spiral blade member (p): 30 mm, thickness of the spiral blade member: 1 mm, radial length of the notches (t): 5 mm, circumferential length of the slit (w): 2 mm, positions of the notches: four per pitch with even distances in the circumferential direction.

(Rotating Member G)

A rotating member G is produced based on the structure shown in FIG. 7, wherein a spiral screw has a spiral blade member (main stirring member) wound right-upward (counterclockwise) on the outer periphery of a shaft member, and a plurality of plate-like vertical blade members (auxiliary stirring members) extending outwardly in the radial direction, and at the end area of the downstream side in the developer carrying direction by 30 mm in length, provided is a paddle part having four stirring members of plate-like blades mounted on the outer periphery of the shaft member and extending outwardly in the radial direction. At both the ends of this rotating member G, provided are disc-like flange members, each having an outer diameter of 24 mm with the shaft member passing through. Specific dimensions of the rotating member G are as follows.

Maximum outer diameter (d): 24 mm, axial length except for shaft portion (size of area where the spiral blade member are mounted): 440 mm, shaft outer diameter: 6 mm, screw pitch of the spiral blade member (p): 30 mm, thickness of the spiral blade member: 1 mm, arrangement of the vertical blade members: one piece per pitch in the center of the pitch space of the spiral blade member, length of the vertical blade member in the axial direction (w): 3 mm, length of the vertical blade member in the radial direction (h): 8 mm (Rotating Member I)

A rotating member I is produced based on the structure shown in FIG. 16, wherein a spiral screw has a spiral blade member (main stirring member) wound right-upward (counterclockwise) on the outer periphery of a shaft member, and a plurality of plate-like vertical blade members (auxiliary stirring members) extending outwardly in the radial direction, and at the end area of the downstream side in the developer carrying direction by 30 mm in length, provided is a paddle part having four stirring members of plate-like blades mounted on the outer periphery of the shaft member and extending outwardly in the radial direction. At both the ends of this rotating member I, provided are disc-like flange members, each having an outer diameter of 24 mm with the shaft member passing through. Specific dimensions of the rotating member I are as follows.

Maximum outer diameter (d): 24 mm, axial length except for shaft portion (size of area where the spiral blade member are mounted): 440 mm, shaft outer diameter: 6 mm, screw pitch of the spiral blade member (p): 30 mm, thickness of the spiral blade member: 1 mm, arrangement of the vertical blade members: four pieces per pitch in the center of the pitch space of the spiral blade member with even spaces in the circumferential direction, length of the vertical blade member in the axial direction (w): 12 mm, length of the vertical blade member in the radial direction (h): 8 mm.

(Rotating Member J)

A rotating member J differs from the rotating member I in that the length of the vertical blade member in the axial direction (w) is set to 20 mm.

(Rotating Member K)

A rotating member K is produced based on the structure shown in FIG. 9, wherein a spiral screw has a spiral blade member (main stirring member) wound right-upward (counterclockwise) on the outer periphery of a shaft member, and two flat plate-like rib members (auxiliary stirring members) positioned on the circumferential edge of the spiral blade member so as to face each other with respect to the shaft member and extending in the rotation axis direction, and at the end area of the downstream side in the developer carrying direction by 30 mm in length, provided is a paddle part having four stirring members of plate-like blades mounted on the outer periphery of the shaft member and extending outwardly in the radial direction. At both the ends of this rotating member K, provided are disc-like flange members, each having an outer diameter of 24 mm with the shaft member passing through. Specific dimensions of the rotating member K are as follows.

Maximum outer diameter (d): 24 mm, axial length except for shaft portion (size of area where the spiral blade member and the plate-like rib members are mounted): 440 mm, shaft outer diameter: 6 mm, screw pitch of the spiral blade member (p): 30 mm, thickness of the spiral blade member: 1 mm, length of the rib member in the radial direction (t): 3 mm.

(Rotating Member L)

A rotating member L differs from the rotating member K in that the length of the rib member in the radial direction (t) is set to 5 mm.

(Rotating Member M)

A rotating member M differs from the rotating member K in that four rib members are arranged on the circumferential edge of the spiral blade member with even spaces in the circumferential direction.

(Rotating Member Q)

A rotating member Q is produced based on the structure shown in FIG. 10, the rotating member Q being cross-shape-paddle-like and having four plate-like rib members (stirring members) on the outer periphery of a shaft member. At both the end of the rotating member Q, provided are disc-like flange members, each having a diameter of 24 mm with the shaft member passing through. Specific dimensions of the rotating member Q are as follows.

Maximum outer diameter (d): 24 mm, axial length except for shaft portion (length in an area direction where the stirring member is placed): 440 mm, shaft outer diameter: 6 mm, length of the rib member in the radial direction (t): 9 mm.

(Rotating Member R)

A rotating member R is produced based on the structure shown in FIG. 12, the rotating member R being in a paddle-like shape and having a plurality of semioval members (main stirring member) and four plate-like rib members (auxiliary stirring member) arranged with equal intervals in the circumferential direction on the peripheral line of the semioval member and extending in the rotation axis direction. At both the ends of the rotating member R, provided are flange members, each having an outer diameter of 24 mm with the shaft member passing through. Specific dimensions of the rotating member R are as follows.

Maximum outer diameter (d): 24 mm, axial length except for shaft portion (size of area where the stirring member is placed): 440 mm, shaft outer diameter: 6 mm, screw pitch of the plate-like member (p): 25 mm, mounting angle of the plate-like member with the shaft member: 90 degree, central angle of the plate-like member (angle area of the shaft member with plate-like member placed on): 270 degree, length of the rib member in the radial direction (t): 5 mm.

(Rotating Member S)

A rotating member S is produced based on the structure shown in FIG. 6, the rotating member S being in a paddle-like shape and having a plurality of semioval members (stirring member). At both the ends of this rotating member S, provided are disc-like flange members, each having a diameter of 24 mm with the shaft member passing through. Specific dimensions of the rotating member S are as follows Maximum outer diameter (d): 24 mm, axial length except for shaft portion (size of area where the spiral blade member is mounted): 440 mm, shaft diameter: 6 mm, mounting angle of the semioval member with the shaft member (α): 45 degree, screw pitch of the semioval member (p); 25 mm.

(Rotating Member T)

A rotating member T is produced based on the structure shown in FIG. 11, the rotating member T being in a paddle-like shape and having a plurality of semioval members (main stirring member) and four plate-like rib members (auxiliary stirring member) arranged with equal intervals in the circumferential direction on the peripheral line of the semioval member and extending in the rotation axis direction. At both the ends of this rotating member T, provided are disc-like flange members, each having an outer diameter of 24 mm with the shaft member passing through. Specific dimensions of the rotating member T are as follows Maximum outer diameter (d): 24 mm, axial length except for shaft portion (size of area where the spiral blade member are mounted): 440 mm, shaft outer diameter: 6 mm, mounting angle of the semioval member with the shaft member (α): 45 degree, screw pitch of the semioval member (p): 25 mm, length of the rib member in the radial direction: 3 mm.

(Rotating Member W)

A rotating member W is produced based on the structure shown in FIG. 15, the rotating member W having a first stirring member 102A group and a second stirring member 102B group, both of which have a plurality of half-oval plates provided along first and second stirring-member arranging-level planes, respectively, inclined in different directions from each other with respect to a plane orthogonal to a shaft member 101. At both the ends of this rotating member W, provided are disc-like flange members 103, each having an outer diameter of 24 mm with the shaft member passing through. Specific dimensions of the rotating member W are as follows.

Maximum outer diameter (d): 24 mm, axial length except shaft portion (size of area where the stirring members are mounted): 440 mm, shaft outer diameter: 6 mm, mounting angle of the first stirring member group with the shaft member (α1): +45 degree, mounting angle of the second stirring member group with the shaft member (α2): −45 degree, screw pitch for the stirring members (p): 25 mm.

(Rotating Member X)

A rotating member X is produced based the structure shown in FIG. 17, the rotating member X having a first stirring member group and a second stirring member group, both of which have a plurality of half-oval plates provided along first and second stirring-member arranging-level planes, respectively, inclined in different directions from each other with respect to planes orthogonal to a shaft member, and auxiliary members being four plate-like members extending in the axial direction provided on the circumferential edge of the first and second stirring member groups with equal intervals in the circumferential direction. At both the ends of this rotating member X, provided are disc-like flange members, each having a diameter of 24 mm with the shaft member passing through. Specific dimensions of the rotating member X are as follows.

Maximum diameter (d): 24 mm, axial length except shaft portion (size of area where the stirring members are mounted): 440 mm, shaft diameter: 6 mm, mounting angle of the first stirring member group with the shaft member (α1): +45 degree, mounting angle of the second stirring member group with the shaft member (α2): −45 degree (inclined in reverse direction to the first stirring member group), screw pitch for the stirring members (p): 25 mm, length of the auxiliary stirring member in the radial direction (t): 3 mm.

[Production of Development Apparatus]

In accordance with the structures shown in FIGS. 2 to 4, development apparatuses 1 to 7 according to the present invention are produced so that rotating members are selected according to TABLE 1 shown below to be used as the developer supplying/collecting section, the first developer stirring section and the second developer stirring section.

Further, a development apparatus 8 is produced for a comparison purpose, wherein the first and second stirring sections are rotated so that each periphery should move from the lower side to the upper side at the point where the two stirring sections face each other.

Figure 19A:
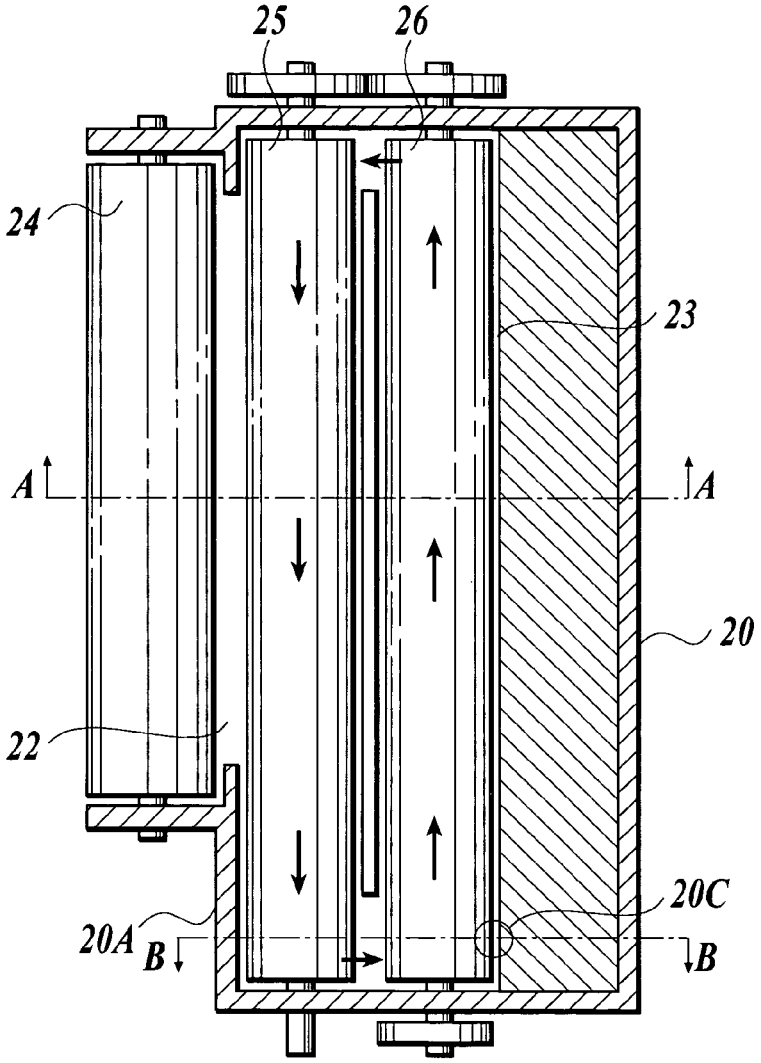
FIG. 19 is a partial cross-sectional pattern diagram showing a rough structure of a development apparatus used in a comparative example in accordance with an experimental example, according to the present invention.
Figure 19B:
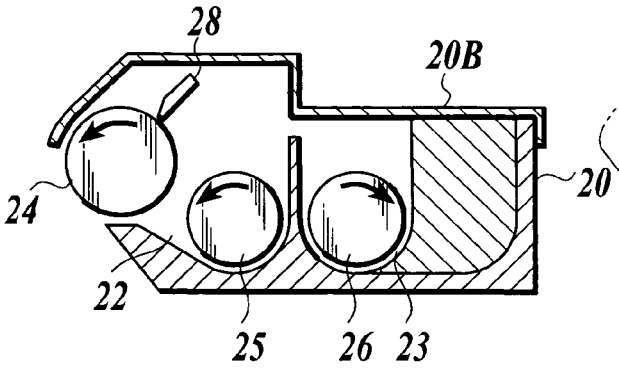
Figure 19C:
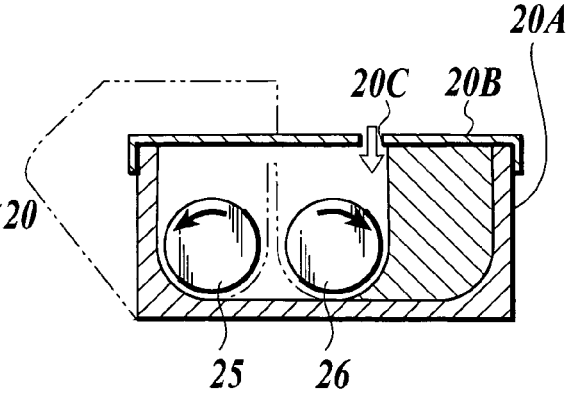

Additionally, development apparatuses 10 to 19 are produced for a comparison purpose according to the structure shown in FIG. 19, which differs from the one shown in FIG. 2 in that the second stirring section is eliminated. The developer supplying/collecting section and the first stirring section in the development apparatuses 10 to 19 use respective rotating members selected according to the combinations shown in TABLE 1.

The developing sleeve of a developer carrying member has an outer diameter of 30 mm and an axial length of 330 mm.

A toner supplying opening in the development apparatuses 1 to 7 and 8 is located above the position where the first and second stirring sections face each other and at 15 mm further downstream side than upstream end in the developer carrying direction in the developer stirring section.

A toner supplying opening in the development apparatus 10 to 19 is located above the edge part of the first stirring section at a rear side and 15 mm further downstream side than upstream end in the developer carrying direction.

Developer for the experiment is of two-component containing a yellow, magenta, cyan or black toner and has a toner density of 7 wt %. Each of the development apparatuses 1 to 7 and 8 has the developer of 1100 g filled therein, and 750 g for the apparatuses 10 to 19.

Each toner for yellow, magenta, cyan and black color is polymerized toner having a volume average particle diameter of 4.5±0.15 μm, CV value of 18±2% ((standard deviation of particle distribution)/(mean particle diameter) *100%), with external additive treatment containing large particle diameter silica of 0.8 wt %, small particle diameter silica of 0.2 wt %, large particle diameter titania of 0.2 wt %, small particle diameter titania of 0.4 wt %, and calcium stearate of 0.05 wt %. A carrier used for any color developer is ferrite particles having a volume average particle diameter of 25 μm and a saturation magnetization of 60 emu/g, and the surface of the particle is coated with acrylic resin so as to have coating amount of 3 wt % to the ferrite particle.

Each of the development apparatuses 1 to 7 according to the present invention and the development apparatuses 8 and 10 to 19 for the comparison purpose is attached to a proper unit driving machine, the rotation speeds of the supplying/collecting section, the first and second stirring sections are respectively set to 400 rpm, and then a developer carrying amount is measured.

In addition, in the development apparatuses 1 to 7, a developer carrying amount is simultaneously measured with the rotation speeds of the developer supplying/collecting section, the first developer stirring section and the second developer stirring section set to 300 rpm.

The result is shown in TABLE 1. The developer carrying amount is measured by the steps of providing a developer outlet on the bottom of the developer housing in the downstream side of the supplying/collecting section, driving only the supplying/collecting section, the first and second stirring sections without driving the developing sleeve, and measuring the weight of the developer discharged from the outlet in a unit time.

[Image Formation Apparatus]

According to the construction shown in FIG. 1, image formation apparatuses 1 to 8 and 10 to 19 were produced for forming color images using the respective development apparatuses 1 to 7, 8 and 10 to 19 as described above. Image output test was carried out under following image formation conditions, which were applied on every toner image forming unit for each color.

<Image Formation Conditions>

Process speed (V): 220 mm/sec (image output speed: 50 sheets per minute)

Rotation speed of the developer supplying/collecting section: 400 rpm

Rotation speed of the first developer stirring section: 400 rpm

Rotation speed of the second developer stirring section: 400 rpm

Rotational number of a developing sleeve: to be adjusted within the range of 210 to 280 rpm so that the toner sticking amount (M) be 0.4 mg per square cm on a photoreceptor drum.

Closest distance between the photoreceptor and the developing sleeve (development gap): 0.3 mm Development bias: alternate current (AC) bias component is superimposed on direct current (DC) bias component, AC bias component; Vac=1 KVpp, fac=5 KHz, sinusoidal wave. DC bias component; controlled to Vdc=VL−500 V, where VL is maximum surface potential detected at exposed portion on the photoreceptor.

Developer carrying amount by the developing sleeve: 25±2 mg per square cm

Width of magnetic brush formed on the developing sleeve in the axis direction: 320 mm

TABLE 1

| | DEVELOPER SUPLLYING/ COLLECTING SECTION | | FIRST DEVELOPER STIRRING SECTION | | SECOND DEVELOPER STIRRING SECTION | | | DEVELOPER MOVING |
|---|---|---|---|---|---|---|---|---|
| DEVELOPMENT APPARATUS | ROTATING MEMBER | ROTATION NUMBER [rpm] | ROTATING MEMBER | ROTATION NUMBER [rpm] | ROTATING MEMBER | ROTATION NUMBER [rpm] | MOVING DIRECTION AT FACING POSITION | AMOUNT [g/sec] |
| 1 | A | 400 | A | SET TO SAME | S | SET TO SAME | UP TO DOWN | 81 |
| | | 300 | | ROTATION | | ROTATION | | 60 |
| 2 | | 400 | | NUMBER AS | Q | NUMBER AS | | 82 |
| | | 300 | | DEVELOPER | | DEVELOPER | | 59 |
| 3 | | 400 | | SUPPLYING/ | R | SUPPLYING/ | | 80 |
| | | 300 | | COLLECTING | | COLLECTING | | 61 |
| 4 | | 400 | | SECTION | T | SECTION | | 78 |
| | | 300 | | | | | | 58 |
| 5 | E | 400 | E | | S | | | 60 |
| | | 300 | | | | | | 44 |
| 6 | G | 400 | G | | | | | 70 |
| | | 300 | | | | | | 52 |
| 7 | A | 400 | S | | C | | | 79 |
| 8 | C | 400 | C | 400 | S | | DOWN TO UP | 82 |
| 10 | A | | A | | | n/a | n/a | 80 |
| 11 | E | | E | | | | | 62 |
| 12 | G | | G | | | | | 77 |
| 13 | I | | I | | | | | 41 |
| 14 | J | | J | | | | | 24 |
| 15 | K | | K | | | | | 54 |
| 16 | L | | L | | | | | 32 |
| 17 | M | | M | | | | | 35 |
| 18 | W | | W | | | | | 23 |
| 19 | X | | X | | | | | 16 |

Toner replenishing control: A toner density sensor (permeability sensor) is provided at 80 mm upstream position from the downstream end in the direction to which the developer is carried by a supplying screw, and a toner replenishing motor is controlled based on the detected result by the sensor.

Toner replenishing speed: maximum 30 g/min

Photoreceptor surface potential:

Maximum surface potential at exposed portion (VL): −50 to −100 V;

Charged potential (potential at non-exposed portion) (VH): to be set to VH=Vdc−150 V according to the DC bias component in the development bias.

Image printout test was carried out by outputting images according to the following cases (1) to (6) four times repeatedly (in total 2,000 sheets of A4 paper), and evaluated based on the occurrence of fog in a character/line pattern, blurring in characters and uneven density in a solid pattern based on the following evaluation bases. The result is shown in TABLE 2.

(1) Printing out 50 sheets continuously, character/line+halftone (10 steps) pattern (dot area occupies 30%), with cyan (C) monochrome.

(2) Printing out 150 sheets continuously, cyan (C) solid pattern (dot area occupies 80%).

(3) Printing out 50 sheets continuously, character/line pattern (dot area occupies 7%), with cyan monochrome.

(4) Printing out 50 sheets continuously, character/line+halftone (10 steps) pattern (both dot areas of magenta (M) and cyan (C) occupy 30%), with single color of blue (magenta (M)+cyan (C)).

(5) Printing out 150 sheets continuously, solid pattern (both dot areas of magenta (M) and cyan (C) occupy 80%), with single color of blue.

(6) Printing out 50 sheets continuously, character/line pattern (dot area occupies 7%), with single color of blue (magenta+cyan).

<Evaluation Bases>

(A) Image Fog:

Assuming that the reflection density of unused paper is zero (0), relative reflection density is measured in white portions of the character/line pattern. If the relative reflection density is not more than 0.004, the image fog is evaluated to be good (represented by a mark 'A'), if more than 0.004 and not more than 0.006, by a mark 'B', and if larger than 0.006, by a mark 'C'.

(B) Blurred Character:

The character blurring was evaluated with sharpness of a character contour and with a degree of blurring of a character when a character in a size of 4-point having therein intricate vertical, horizontal and oblique lines such as a Chinese character meaning a bell in English (hereinafter referred to as "Bell") was enlarged and observed.

The occasion wherein a void space of a character of "Bell" is clear, a character contour is distinct and toner blurring on the peripheral portion of the character is extremely little was represented by 'A', the occasion wherein a void space of a character of "Bell" lacks detail slightly (slightly filled with toner blurring), but toner blurring on the peripheral portion of the character is little was represented by 'B', and the occasion wherein a void space of a character of "Bell" lacks detail (filled with toner blurring), toner blurring on the peripheral portion of the character is a lot and a character contour is bleeding was represented by 'C'.

(C) Uneven Image Density:

The uneven image density is evaluated by color differences (distance in an L*a*b* space) at any nine points within the page printed with a monochrome cyan solid pattern or blue solid pattern. If the color differences within the cyan solid pattern are not more than 3 and those for the blue solid pattern are not more than 7, it is represented by a mark 'A'. If the color differences for the cyan solid pattern are more than 3 and not more than 5 and those for the blue solid pattern are not more than 7, or if those for the cyan solid pattern are not more than 3 and those for the blue solid pattern are more than 7 and not more than 9, presented by a mark 'B'. If the color differences for the cyan solid pattern are more than 3 and those for the blue solid pattern are more than 9, represented by a mark 'C'.

(D) Contamination within the Apparatus:

The contamination within the apparatus is evaluated by visually checking the contamination around the development apparatus mounting portions when the development apparatus are taken out after completion of the image output test.

If the contaminated portion within the apparatus is not recognized, or only the mounting portion is very slightly contaminated, it is represented by a mark 'A', if slightly found contaminated around the development apparatus mounting portions (for example, at both ends), by a mark 'B', and if the developer device mounting portions as well as the neighbor of the mounting portions (for example, charging devices) become contaminated, by a mark 'C'.

TABLE 2

| IMAGE | DEVELOPER SUPPLYING/ COLLECTING SECTION | | FIRST DEVELOPER STIRRING SECTION | | SECOND DEVELOPER STIRRING SECTION | |
|---|---|---|---|---|---|---|
| FORMATION APPARATUS | ROTATING MEMBER | ROTATION NUMBER [rpm] | ROTATING MEMBER | ROTATION NUMBER [rpm] | ROTATING MEMBER | ROTATION NUMBER [rpm] |
| 1 | A | 400<br>300 | A | SET TO SAME ROTATION NUMBER AS DEVELOPER SUPPLYING/ COLLECTING SECTION | S | SET TO SAME ROTATION NUMBER AS DEVELOPER SUPPLYING/ COLLECTING SECTION |
| 2 | | 400<br>300 | | | Q | |
| 3 | | 400<br>300 | | | R | |
| 4 | | 400<br>300 | | | T | |
| 5 | E | 400<br>300 | E | | S | |

TABLE 2-continued

| | | | | | | |
|---|---|---|---|---|---|---|
| 6 | G | 400 | G | | | |
| | | 300 | | | | |
| 7 | A | 400 | S | | C | |
| 8 | C | 400 | C | SET TO SAME | S | |
| 10 | A | | A | ROTATION | | n/a |
| 11 | E | | E | NUMBER AS | | |
| 12 | G | | G | DEVELOPER | | |
| 13 | I | | I | SUPPLYING/ | | |
| 14 | J | | J | COLLECTING | | |
| 15 | K | | K | SECTION | | |
| 16 | L | | L | | | |
| 17 | M | | M | | | |
| 18 | W | | W | | | |
| 19 | X | | X | | | |

| IMAGE | USING COLOR IMAGE FORMATION APPARATUS (FIG. 1) EVALUATION | | | |
|---|---|---|---|---|
| FORMATION APPARATUS | IMAGE FOG | CHARACTER BLURRING | UNEVEN IMAGE DENSITY | CONTAMINATION IN APPARATUS |
| 1 | A | A | A | A |
| | A | A | A | A |
| 2 | A | A | A | A |
| | A | A | A | A |
| 3 | A | A | A | A |
| | A | A | A | A |
| 4 | A | A | A | A |
| | A | A | A | A |
| 5 | A | A | A | A |
| | A | A | A | A |
| 6 | A | A | A | A |
| | A | A | A | A |
| 7 | A | A | B | A |
| 8 | C | C | C | C |
| | C | C | C | C |
| 11 | C | C | C | C |
| 12 | C | C | C | C |
| 13 | C | C | B | C |
| 14 | A | A | C | B |
| 15 | B | B | C | B |
| 16 | A | A | C | A |
| 17 | A | A | C | A |
| 18 | C | C | C | C |
| 19 | C | C | C | C |

[Production of Development Apparatus]

In regard to each of the above-mentioned development apparatuses 1, 3 and 4, and the development apparatuses for the comparison purpose 10 to 19, produced are development apparatuses 20 to 22 according to the present invention, having approximately the same structures as the development apparatuses 1, 3 and 4 except that a recycled toner mixing opening is formed at 8 mm further upstream than the toner supplying opening in the developer carrying direction within the developer stirring section, and development apparatuses 24 to 33 having the same structure as the development apparatuses for the comparison purpose 10 to 19.

In accordance with the structure in FIG. 2, image formation apparatuses 20 to 33 having the toner recycling section are produced for forming monochrome images, including each of the development apparatuses 20 to 22 according to the present invention as above and the development apparatuses for the comparison purpose 24 to 33. The toner recycling section is structured to have maximum 30 g/min in toner carrying amount per unit time carried by the carrying section for carrying the recycled toner to the development apparatus.

Each of the image formation apparatuses 20 to 33 has a process speed of 320 mm/sec (image output speed: 65 sheets per minute). In the development apparatuses 20 to 22, the rotation speed of the developer supplying/collecting section, the first developer stirring section and the second developer stirring section is set to 400 rpm. In the development apparatuses 24 to 26, the rotation speed of the developer supplying/collecting section and the first developer stirring section is set to 400 rpm. In the development apparatuses 27 to 33, the rotation speed of the developer supplying/collecting section and the first developer stirring section is set to 650 rpm. Other than these settings, under the same image formation conditions as the toner image formation unit according to a black toner image of the color image formation apparatus shown in FIG. 1 used in the experiment above, image printout test was carried out by outputting images according to the following cases (7) to (9) eight times repeatedly (in total 2,000 sheets of A4 paper), and evaluated based on the occurrence of fog in a character/line pattern, blurring in characters and contamination within the apparatus based on the evaluation bases described above, and also the occurrence of uneven image density in a solid pattern based on the following evaluation bases. The result is shown in TABLE 3.

(7) Printing out 50 sheets continuously, character/line+halftone (10 steps) pattern (dot area occupies 30%), with black (BK) monochrome.

(8) Printing out 150 sheets continuously, black (BK) monochromatic solid pattern (dot area occupies 80%).

(9) Printing out 50 sheets continuously, character/line pattern (dot area occupies 7%), with black monochrome.

<Evaluation Bases>

The uneven image density is evaluated by the relative reflection density at any 9 points within the page printed with single color solid pattern of black (BK). If all of the relative reflection densities within the single color solid pattern of black (BK) are 1.3 or above and the difference between the maximum and minimum values is 0.1 or below, it is represented by a mark 'A'. If the minimum value is not less than 1.2 and less than 1.3 and the difference between the maximum and minimum values is not more than 0.1, it is presented by a mark 'B', and if the minimum value is less than 1.2 or the difference between the maximum and minimum values is more than 0.15, represented by a mark 'C'.

Experimental Example 2

[Production of Development Apparatus]

In regard to the second embodiment, produced are rotating members (rotating members A, C, E, F, G, H, I, J, K, L, M, N, O, P, U, V, W and X) to be used as the developer supplying/collecting section 95, and the first and second developer stirring sections 96 and 97, based on the structure shown in FIG. 14. Among them, since the rotating members A, C, E, G, I, J, K, L, M, W and X are the same as the ones used in the above experimental example 1, description thereof is omitted and only rotating members which are newly used will be described.

(Rotating Member F)

A rotating member F differs from the rotating member E used in the experimental example 1 in that the screw pitch (p) is set to 20 mm.

(Rotating Member H)

A rotating member H differs from the rotating member G used in the experimental example 1 in that the screw pitch (p) is set to 20 mm.

(Rotating Member N)

A rotating member N differs from the rotating member K used in the experimental example 1 in that a spiral blade

TABLE 3

| | DEVELOPER SUPLLYING COLLECTING SECTION | | FIRST DEVELOPER STIRRING SECTION | | SECOND DEVELOPER STIRRING SECTION | | DEVEL-OPER |
|---|---|---|---|---|---|---|---|
| DEVELOPMENT APPARAUTS | ROTATING MEMBER | ROTATION NUMBER [rpm] | ROTATING MEMBER | ROTATION NUMBER [rpm] | ROTATING MEMBER | ROTATION NUMBER [rpm] | MOVING AMOUNT [g/sec] |
| 20 | A | 400 | A | 400 | S | 400 | 81 |
| 21 | | | | | Q | | 82 |
| 22 | | | | | T | | 78 |
| 24 | A | 400 | A | 400 | n/a | | 80 |
| 25 | E | | E | | | | 62 |
| 26 | G | | G | | | | 77 |
| 27 | I | 650 | I | | | | 66 |
| 28 | J | | J | | | | 38 |
| 29 | K | | K | | | | 84 |
| 30 | L | | L | | | | 50 |
| 31 | M | | M | | | | 51 |
| 32 | W | | W | | | | 32 |
| 33 | X | | X | | | | 21 |

| | | USING MONOCHROME IMAGE FORMATION APPARATUS (FIG. 13) EVALUATION | | | |
|---|---|---|---|---|---|
| DEVELOPMENT APPARAUTS | IMAGE FORMATION APPARATUS | IMAGE FOG | CHARACTER BLURRING | UNEVEN IMAGE DENSITY | CONTAMINATION IN APPARATUS |
| 20 | 20 | A | A | A | A |
| 21 | 21 | A | A | A | A |
| 22 | 22 | A | A | A | A |
| 24 | 24 | C | C | C | C |
| 25 | 25 | C | C | C | C |
| 26 | 26 | C | C | C | C |
| 27 | 27 | DUE TO DRASTIC INCREASE OF STIRRING TORQUE, IMAGE FORMATION WAS DISCONTINUED. ACCORDING TO THE INVESTIGATION, IT WAS CONFIRMED THAT DEVELOPER ADHERED TO A SHAFT MEMBER | | | |
| 28 | 28 | | | | |
| 29 | 29 | | | | |
| 30 | 30 | | | | |
| 31 | 31 | | | | |
| 32 | 32 | | | | |
| 33 | 33 | | | | |

member (main stirring member) is would left-upward (clockwise) on the outer periphery of a shaft member and the screw pitch is set to 20 mm.

(Rotating Member O)

A rotating member O differs from the rotating member L used in the experimental example 1 in that a spiral blade member (main stirring member) is wound left-upward (clockwise) on the outer periphery of a shaft member.

(Rotating Member P)

A rotating member P differs from the rotating member M used in the experimental example 1 in that a spiral blade member (main stirring member) is wound left-upward (clockwise) on the outer periphery of a shaft member.

(Rotating Member U)

A rotating member U differs from the rotating member W used in the experimental example 1 in that the mounting angle of the first stirring member group 102A with the shaft member 101 shown in FIG. 15 (α1) is set to −45 degree, and the mounting angle of the second stirring member group 102B with the shaft member 101 (α2) is set to +45 degree.

(Rotating Member V)

A rotating member V differs from the rotating member X used in the experimental example 1 in that the mounting angle of the first stirring member group with the shaft member shown in FIG. 17 (α1) is set to −45 degree, and the mounting angle of the second stirring member group with the shaft member (α2) is set to +45 degree.

[Production of Development Apparatus]

In accordance with the structure shown in FIG. 14, development apparatuses 34 to 41 according to the present invention are produced so that rotating members are selected according to TABLE 4 shown below to be used as the developer supplying/collecting section, the first developer stirring section, and the second developer stirring section. Further, a development apparatus 9 is produced for a comparison purpose, wherein the first developer stirring member and the second developer stirring member are selected according to TABLE 4 below, and the first and second developer stirring sections are rotated so that each periphery should move from the lower side to the upper side at the point where the two stirring sections face each other.

Further, the other conditions are basically the same as the ones of the above experimental experiment 1.

TABLE 4

| | DEVELOPER SUPLLYING/ COLLECTING SECTION | | FIRST DEVELOPER STIRRING SECTION | | SECOND DEVELOPER STIRRING SECTION | | MOVING DIRECTION | DEVEL-OPER MOVING |
|---|---|---|---|---|---|---|---|---|
| DEVELOPMENT APPARATUS | ROTATING MEMBER | ROTATION NUMBER [rpm] | ROTATING MEMBER | ROTATION NUMBER [rpm] | ROTATING MEMBER | ROTATION NUMBER [rpm] | AT FACING POSITION | AMOUNT [g/sec] |
| 34 | A | 400 | K | 400 | U | 400 | UP TO DOWN | 79 |
| 35 | | | E | | V | | | 80 |
| 36 | | | F | | O | | | 82 |
| 37 | | | H | | | | | 78 |
| 38 | | | | | P | | | 81 |
| 39 | G | | L | | O | | | 78 |
| 40 | | | M | | P | | | 80 |
| 41 | E | | W | | N | | | 81 |
| 9 | C | 400 | O | 400 | L | 400 | DOWN TO UP | 80 |

[Image Formation Apparatus]

According to the structure shown in FIG. 1, image formation apparatuses 34 to 40 and 9 on which the above-described development apparatuses 34 to 41 according to the present invention and the development apparatus 9 for the comparison purpose respectively were produced, and image output test was carried out under following image formation conditions, which are applied on every toner image forming unit for each color.

Here, the image formation conditions and the evaluation bases are the same as the above-mentioned experimental experiments 1 and 2.

The result thereof is shown in TABLE 5.

TABLE 5

| IMAGE | DEVELOPER SUPPLYING/ COLLECTING SECTION | | FIRST DEVELOPER STIRRING SECTION | | SECOND DEVELOPER STIRRING SECTION | |
|---|---|---|---|---|---|---|
| FORMATION APPARATUS | ROTATING MEMBER | ROTATION NUMBER [rpm] | ROTATING MEMBER | ROTATION NUMBER [rpm] | ROTATING MEMBER | ROTATION NUMBER [rpm] |
| 34 | A | 400 | K | 400 | U | 400 |
| 35 | | | E | | V | |
| 36 | | | F | | O | |
| 37 | | | H | | | |

TABLE 5-continued

| | | | |
|---|---|---|---|
| 38 | | | P |
| 39 | G | L | O |
| 40 | | M | P |
| 41 | E | W | N |
| 9 | C | O | L |

| IMAGE FORMATION APPARATUS | USING COLOR IMAGE FORMATION APPARATUS (FIG. 1) EVALUATION | | | |
|---|---|---|---|---|
| | IMAGE FOG | CHARACTER BLURRING | UNEVEN IMAGE DENSITY | CONTAMINATION IN APPARATUS |
| 34 | A | A | A | A |
| 35 | A | A | A | A |
| 36 | A | A | A | A |
| 37 | A | A | A | A |
| 38 | A | A | A | A |
| 39 | A | A | A | A |
| 40 | A | A | A | A |
| 41 | A | A | B | A |
| 9 | C | C | C | C |

[Production of Development Apparatus]

Further, produced were development apparatuses 42 to 46 having the same structures as the development apparatuses 34 to 38 except that a recycled-toner recycled toner mixing opening is formed at a position 8 mm further upstream than the toner supplying opening in the developer carrying direction within the developer stirring section, and image formation apparatuses 42 to 46 for forming a monochrome image having the development apparatuses 42 to 46.

Then, the image output test was carried out under the same conditions for the toner image formation unit according to a black toner image used in the first experimental example except that the process speed is set to 320 mm/sec (image output speed: 65 sheets per minute) and each rotation speed of the developer supplying/collecting section, the first developer stirring section and the second developer stirring section is set according to the conditions shown in TABLE 6 below.

The result is shown in the following TABLE 6.

[Experimental Experiment 3]

[Production of Rotating Members]

Experiment was carried out according to the third embodiment. Produced are rotating members (rotating members A, D, E, G, I, J, K, M, N, O, P, W and X) to be used as the developer supplying/collecting section, the first developer stirring section and the second developer stirring section.

Here, since the rotating members A, E, G, I, J, K, L, M, N, O, P, W and X are the same as the ones described in either the above experimental experiment 1 or the experimental experiment 2, a rotating member D will be only described.

(Rotating Member D)

A rotating member D differs from the rotating member A used in the experimental experiment 1 in that the spiral blade member (main stirring member) is wound left-upward

TABLE 6

| DEVELOPMENT APPARAUTS | DEVELOPER SUPLLYING COLLECTING SECTION | | FIRST DEVELOPER STIRRING SECTION | | SECOND DEVELOPER STIRRING SECTION | | DEVEL-OPER |
|---|---|---|---|---|---|---|---|
| | ROTATING MEMBER | ROTATION NUMBER [rpm] | ROTATING MEMBER | ROTATION NUMBER [rpm] | ROTATING MEMBER | ROTATION NUMBER [rpm] | MOVING AMOUNT [g/sec] |
| 42 | A | 400 | K | 400 | U | 400 | 79 |
| 43 | | | E | | V | | 80 |
| 44 | | | F | | O | | 82 |
| 45 | | | H | | | | 78 |
| 46 | | | | | P | | 81 |

| DEVELOPMENT APPARAUTS | IMAGE FORMATION APPARATUS | USING MONOCHROME IMAGE FORMATION APPARATUS (FIG. 13) EVALUATION | | | |
|---|---|---|---|---|---|
| | | IMAGE FOG | CHARACTER BLURRING | UNEVEN IMAGE DENSITY | CONTAMINATION IN APPARATUS |
| 42 | 42 | A | A | A | A |
| 43 | 43 | A | A | A | A |
| 44 | 44 | A | A | A | A |
| 45 | 45 | A | A | A | A |
| 46 | 46 | A | A | A | A |

(clockwise) on the outer periphery of a shaft member, and the screw pitch (p) is set to 40 mm.

[Production of Development Apparatus]

In accordance with the structure shown in FIG. 18, development apparatuses 47 to 53 according to the present invention are produced such that rotating members are selected according to TABLE 7 shown below to be used as the developer supplying/collecting section, the first developer stirring section, and the second developer stirring section.

Here, the other conditions are the same as the above experimental experiments 1 and 2.

The result thereof is shown in TABLE 7.

[Production of Development Apparatus]

Produced were development apparatuses 54 to 58 having the same structure as the development apparatuses 47 to 51 except that a recycled-toner recycled toner mixing opening is formed at a position 8 mm further upstream than the toner supplying opening in the developer carrying direction within the developer stirring section, and image formation apparatuses 54 to 58 for forming a monochrome image having the development apparatuses 54 to 58. Then, actuation test was carried out.

The image formation conditions and the evaluation bases are the same as the above-mentioned experimental experiment 2.

TABLE 7

| | DEVELOPER SUPLLYING/ COLLECTING SECTION | | FIRST DEVELOPER STIRRING SECTION | | SECOND DEVELOPER STIRRING SECTION | | MOVING DIRECTION | DEVEL-OPER MOVING |
|---|---|---|---|---|---|---|---|---|
| DEVELOPMENT APPARATUS | ROTATING MEMBER | ROTATION NUMBER [rpm] | ROTATING MEMBER | ROTATION NUMBER [rpm] | ROTATING MEMBER | ROTATION NUMBER [rpm] | AT FACING POSITION | AMOUNT [g/sec] |
| 47 | A | 400 | N | 400 | D | 400 | UP TO DOWN | 81 |
| 48 | | | W | | | | | 78 |
| 49 | | | X | | | | | 80 |
| 50 | E | | O | | | | | 59 |
| 51 | | | P | | | | | 61 |
| 52 | G | | W | | | | | 77 |
| 53 | | | X | | | | | 78 |

[Image Formation Apparatus]

According to the structure shown in FIG. 1, produced were image formation apparatuses 47 to 53 for forming color images respectively using the development apparatuses 47 to 53 according to the above present invention, and image output test was carried out.

Here, the image formation conditions and the evaluation bases are the same as the above-mentioned experimental experiments 1 and 2.

The result is shown in TABLE 8.

TABLE 8

| IMAGE | DEVELOPER SUPPLYING/ COLLECTING SECTION | | FIRST DEVELOPER STIRRING SECTION | | SECOND DEVELOPER STIRRING SECTION | |
|---|---|---|---|---|---|---|
| FORMATION APPARATUS | ROTATING MEMBER | ROTATION NUMBER [rpm] | ROTATING MEMBER | ROTATION NUMBER [rpm] | ROTATING MEMBER | ROTATION NUMBER [rpm] |
| 47 | A | 400 | N | 400 | D | 400 |
| 48 | | | W | | | |
| 49 | | | X | | | |
| 50 | E | | O | | | |
| 51 | | | P | | | |
| 52 | G | | W | | | |
| 53 | | | X | | | |

| IMAGE | USING COLOR IMAGE FORMATION APPARATUS (FIG. 1) EVALUATION | | | |
|---|---|---|---|---|
| FORMATION APPARATUS | IMAGE FOG | CHARACTER BLURRING | UNEVEN IMAGE DENSITY | CONTAMINATION IN APPARATUS |
| 47 | A | A | A | A |
| 48 | A | A | A | A |
| 49 | A | A | A | A |
| 50 | A | A | A | A |
| 51 | A | A | A | A |
| 52 | A | A | A | A |
| 53 | A | A | A | A |

The result is shown in TABLE 9.

TABLE 9

| DEVEL- | DEVELOPER SUPPLYING/ COLLECTING SECTION | | FIRST DEVELOPER STIRRING SECTION | | SECOND DEVELOPER STIRRING SECTION | |
|---|---|---|---|---|---|---|
| OPMENT APPARATUS | ROTATING MEMBER | ROTATION NUMBER [rpm] | ROTATING MEMBER | ROTATION NUMBER [rpm] | ROTATING MEMBER | ROTATION NUMBER [rpm] |
| 53 | A | 400 | N | 400 | D | 400 |
| 54 | | | W | | | |
| 55 | | | X | | | |
| 56 | E | | O | | | |
| 57 | | | P | | | |

| DEVEL- | USING COLOR IMAGE FORMATION APPARATUS (FIG. 13) EVALUATION | | | |
|---|---|---|---|---|
| OPMENT APPARATUS | IMAGE FOG | CHARACTER BLURRING | UNEVEN IMAGE DENSITY | CONTAMINATION IN APPARATUS |
| 53 | A | A | A | A |
| 54 | A | A | A | A |
| 55 | A | A | A | A |
| 56 | A | A | A | A |
| 57 | A | A | A | A |

From the above experimental experiments 1 to 3, following result is confirmed: with the use of an image formation apparatus according to the present invention, even if toner consumption is very large and the toner, including the recycled toner, is replenished repeatedly due to continuously outputting images having high dot area percent, it is possible to obtain charge rising characteristic sufficiently in the developer, and further to supply the developer to the developer carrying member with even toner density in the axial direction, and thereby, it is possible to securely prevent the occurrence of image defects, such as the fog, the character blurring and the uneven image density, as well as contamination inside of the apparatus due to toner scattering. As a result, it is possible to obtain high quality images steadily.

It is confirmed, on the other hand, that the image formation apparatus produced for the comparison purpose makes at least one problem among image fog, character blurring, uneven image density and contamination inside of the apparatus, and has difficulty in obtaining high quality images steadily. Specifically, in the image formation apparatus with a toner recycling mechanism for forming monochromatic images, if the rotating speed of the rotating member was raised to obtain sufficient developer moving speed for preventing the occurrence of uneven image density in the axial direction, stirring torque increased drastically, which forced the image output test to be discontinued without outputting images. It was found by investigation of the cause that the developer started melting and adhering to the shaft portion.

The entire disclosure of Japanese Patent Application Nos. Tokugan 2003-2675 filed on Apr. 28, 2003, Tokugan 2003-2676 filed on Apr. 28, 2003 and Tokugan 2003-2677 filed on Apr. 28, 2003, including specifications, claims, drawings and summaries are incorporated herein by reference in their entirety.

What is claimed is:

1. A development apparatus, comprising:

a housing including a developer supplying/collecting unit and a developer stirring unit arranged in a front-and-rear direction and a projecting portion, the developer supplying/collecting unit and the developer stirring unit together forming a circular passage for carrying a two-component developer including a toner and a carrier;

a developer carrying member arranged at a front side portion of the developer supplying/collecting unit to face an image carrying member with respect to a development region;

a developer supplying/collecting section for carrying the developer in a rotation axis direction, the developer supplying/collecting section arranged at a rear side portion of the developer supplying/collecting unit to face the developer carrying member and to extend along a rotation axis direction of the developer carrying member;

a first developer stirring section and a second developer stirring section arranged in a front-and-rear direction in the developer stirring unit to face each other and to extend along a rotation axis direction of the developer supplying/collecting section, the first and second developer stirring sections having peripheries that rotate and move the developer from an upstream side to a downstream side in a first developer carrying direction in the developer stirring unit; and a toner supply opening formed above a position where the first and second developer stirring sections face each other in the projecting portion and at the upstream side in the first developer carrying direction in the developer stirring unit, wherein the first developer carrying direction in the developer stirring unit is substantially opposite to a second developer carrying direction in the developer supplying/collecting section, wherein an amount of the developer carried by the first and second developer stirring sections is equal to an amount of the developer carried by the developer supplying/collecting section, and wherein the projecting portion projects outwardly in an axial direction from an end portion of the developer carrying member and supports end portions of the developer supplying/collecting section and the first and second developer stirring sections.

2. The apparatus of claim 1, wherein the first developer stirring section carries the developer in a direction opposite to a direction in which the developer supplying/collecting section carries the developer, wherein an amount of the developer carried by the first developer stirring section in the rotation axis direction is equal to the amount of the developer carried by the developer supplying/collecting section, and wherein the second developer stirring section carries substantially no developer in the rotation axis direction.

3. The apparatus of claim 2, wherein the second developer stirring section is arranged at a rear side portion with respect to the developer supplying/collecting unit.

4. The apparatus of claim 3, wherein the toner has a volume average particle diameter of 3 μm to 5 μm, and the carrier has a volume average particle diameter of 5×Dt (μm) to 10×Dt (μm).

5. The apparatus of claim 2, wherein the developer supplying/collecting section includes a first stirring member which extends spirally in the rotation axis direction throughout an outer periphery of a first shaft member, and the first stirring section includes a second stirring member which extends spirally in the rotation axis direction throughout an outer periphery of a second shaft member, the second stirring member carrying the developer in a direction opposite to a direction in which the developer supplying/collecting section carries the developer, wherein an amount of the developer carried by the second stirring member in the rotation axis direction is equal to the amount of the developer carried by the developer supplying/collecting section, and wherein the second developer stirring section includes a plurality of plate-like stirring members with a third shaft member passing through, the plurality of stirring members inclined in a same direction with respect to the third shaft member, and carries substantially no developer in the rotation axis direction.

6. The apparatus of claim 5, wherein the second developer stirring section is arranged at a rear side portion with respect to the developer supplying/collecting unit.

7. The apparatus of claim 6, wherein the toner has a volume average particle diameter of 3 μm to 5 μm, and the carrier has a volume average particle diameter of 5×Dt (μm) to 10×Dt (μm).

8. The apparatus of claim 2, wherein the developer supplying/collecting section includes a first stirring member which extends spirally in the rotation axis direction throughout an outer periphery of a first shaft member, and the first developer stirring section includes a second stirring member which extends spirally in the rotation axis direction throughout an outer periphery of a second shaft member, the second stirring member carrying the developer in a direction opposite to a direction in which the developer supplying/collecting section carries the developer, wherein an amount of the developer carried by the second stirring member in the rotation axis direction is equal to the amount of the developer carried by the developer supplying/collecting section, and wherein the second developer stirring section includes a third stirring member having a rib formed on an outer periphery of a third shaft member, and carries substantially no developer in the rotation axis direction.

9. The apparatus of claim 8, wherein the second developer stirring section is arranged at a rear side portion with respect to the developer supplying/collecting unit.

10. The apparatus of claim 9, wherein the toner has a volume average particle diameter of 3 μm to 5 μm, and, the carrier has a volume average particle diameter of 5×Dt (μm) to 10×Dt (μm).

11. An image formation apparatus, comprising:

an image carrying member; and a toner image formation section for forming a toner image by developing an electrostatic image formed on the image carrying member, wherein the toner image formation section includes the development apparatus of claim 2, and wherein the following conditions (1) and (2) are satisfied:

$$W \geqq M\ V\ H\ L/1000 \qquad \text{Condition (1)}$$

$$R \leqq 600 \qquad \text{Condition (2)}$$

where V represents a moving speed (mm/sec) of the image carrying member, M represents a maximum toner amount attaching to one unit area in the toner image formed on the image carrying member (mg/$cm^2$), L represents a maximum width (mm) of the toner image formed on the image carrying member in a direction perpendicular to a moving direction of the image carrying member, W represents a developer carrying amount (g/sec) by the developer supplying/collecting section in the rotation axis direction, and R represents a rotation number of the developer supplying/collecting section.

12. An image formation apparatus, comprising:

an image carrying member;

a toner image formation section for forming a toner image by developing an electrostatic image formed on the image carrying member;

a transferring section for transferring the toner image on the image carrying member to a transferring material or an intermediate transferring member;

a cleaning section for removing toner which remains on the image carrying member after the toner image is transferred; and a toner recycling section for collecting the toner removed from the image carrying member to be reused, wherein the toner image formation section includes the development apparatus of claim 2, and wherein in the housing of the development apparatus, a recycled toner mixing opening is formed above the position where the first and second developer stirring sections face each other and at the upstream side with respect to the toner supplying opening in the first developer carrying direction in the developer stirring unit, for mixing the toner collected by the toner recycling section into the developer stirring unit.

13. The apparatus of claim 2, wherein peripheries of the developer carrying member and the developer supplying/collecting section move in opposite directions with respect to each other at a position where the developer carrying member and the developer supplying/collecting section face each other.

14. The apparatus of claim 2, wherein the housing includes a partition between the developer supplying/collecting unit and the developer stirring unit to avoid mixing the developer therein, the developer moves to edge portions of both the developer supplying/collecting unit and the developer stirring unit in a longitudinal direction; and a space is formed between the first and second developer stirring sections to allow the developer to freely circulate between the first and second developer stirring sections.

15. The apparatus of claim 1, wherein both the two developer stirring sections in the developer stirring unit carry the developer in a direction opposite to a direction in which the developer supplying/collecting section carries the developer, and have the developer carrying capability so as to make the sum total of the developer carrying amount by the two developer stirring sections in the rotation axis direction equal to that by the developer supplying/collecting section.

16. The apparatus of claim 15, wherein one of the two developer stirring sections in the developer stirring unit has the developer carrying capability in the rotation axis direction lower than or equal to that of another developer stirring section, and is placed at a rear side with respect to the developer supplying/collecting unit.

17. The apparatus of claim 16, wherein the two-component developer is composed of the toner having a volume average particle diameter of 3 μm to 5 μm, and, denoting the volume average particle diameter of the toner by Dt (μm), the carrier having volume average particle diameter of 5×Dt to 10×Dt.

18. The apparatus of claim 15, wherein the developer supplying/collecting section comprises a stirring member extending spirally in the rotation axis direction throughout an outer periphery of a shaft member, one of the two developer stirring sections comprises a stirring member extending spirally in the rotation axis direction throughout an outer periphery of a shaft member, and another developer stirring section comprises a plurality of semioval first stirring members and a plurality of semioval second stirring members on an outer periphery of a shaft member, the plurality of first stirring members being placed along a first stirring member arrangement plane, the plurality of second stirring members being placed along a second stirring member arrangement plane, the first stirring member arrangement plane and the second stirring member arrangement plane being inclined in different directions from each other with respect to a plane perpendicular to the shaft member.

19. The apparatus of claim 18, wherein another developer stirring section in the developer stirring unit has the developer carrying capability in the rotation axis direction equal to or lower than that of the one developer stirring section, and is placed at a rear side with respect to the developer supplying/collecting unit.

20. The apparatus of claim 19, wherein the two-component developer is composed of the toner having a volume average particle diameter of 3 μm to 5 μm, and, denoting the volume average particle diameter of the toner by Dt (μm), the carrier having volume average particle diameter of 5×Dt to 10×Dt.

21. The apparatus of claim 15, wherein the developer supplying/collecting section comprises a stirring member extending spirally in the rotation axis direction throughout an outer periphery of a shaft member, one of the two developer stirring sections comprises a stirring member extending spirally in the rotation axis direction throughout an outer periphery of a shaft member, and another developer stirring section comprises a stirring member comprising a rib placed on an outer periphery of a shaft member or at a position with being apart from each other with respect to the shaft member in a radial direction so as to extend along the rotation axis direction.

22. The apparatus of claim 21, wherein another developer stirring section in the developer stirring unit has the developer carrying capability in the rotation axis direction equal to or lower than that of the one developer stirring section, and is placed at a rear side with respect to the developer supplying/collecting unit.

23. The apparatus of claim 22, wherein the two-component developer is composed of the toner having a volume average particle diameter of 3 μm to 5 μm, and, denoting the volume average particle diameter of the toner by Dt (μm), the carrier having volume average particle diameter of 5×Dt to 10×Dt.

24. An image formation apparatus comprising a latent image carrying member and a toner image formation section for forming a toner image by developing an electrostatic latent image formed on the latent image carrying member, wherein the toner image formation section includes the development apparatus of claim 15, and following conditions (1) and (2) are satisfied:

$$W \geqq M\,V\,H\,L/1000 \qquad \text{Condition (1)}$$

$$R \leqq 600 \qquad \text{Condition (2)}$$

where V represents a moving speed (mm/sec) of the latent image carrying member, M represents maximum toner amount attaching to one unit area in the toner image formed on the latent image carrying member (mg/cm$^2$), L represents maximum width (mm) of the toner image formed on the latent image carrying member in a direction perpendicular to a moving direction of the latent image carrying member, W represents developer carrying amount (gisec) by the developer supplying/collecting section in the rotation axis direction, and R represents rotation number of the developer supplying/collecting section.

25. An image formation apparatus comprising a latent image carrying member, a toner image formation section for forming a toner image by developing an electrostatic latent image formed on the latent image carrying member, a transferring section for transferring the toner image on the latent image carrying member to transferring material or an intermediate transferring member, a cleaning section for removing toner remained on the latent image carrying member after the toner image is transferred, and a toner recycling section for collecting the toner removed from the latent image carrying member to be reused, wherein the toner image formation section includes the development apparatus of claim 15, and in the housing structuring the development apparatus, a recycled toner mixing opening is placed above the position where the two developer stirring sections face each other and at an upstream side with respect to the toner supplying opening in the developer carrying direction in the developer stirring unit, for mixing the toner collected by the toner recycling section into the developer stirring unit.

26. The apparatus of claim 15, wherein, in the developer supplying/collecting unit, peripheries of the developer carrying member and the developer supplying/collecting section are moved in opposite directions to each other at a position where the developer carrying member and the developer supplying/collecting section face each other.

27. The apparatus of claim 15, wherein, in the housing, there is a partition between the developer supplying/collecting unit and the developer stirring unit for separating space so as to avoid mixing the developer in the developer supplying/collecting unit and the developer in the developer stirring unit;

the partition enables the developer in both the developer supplying/collecting unit and the developer stirring unit to move to each other at both edge parts in a longitudinal direction of both the developer supplying/collecting unit and the developer stirring unit; and a space is secured between the two developer stirring section in the developer stirring unit so as to make the developer circulate between the two developer stirring sections freely.

28. The apparatus of claim 1, wherein one of the two developer stirring sections in the developer stirring unit carries the developer in a same direction as a direction in which the developer supplying/collecting section carries the developer, and has the developer carrying capability in the rotation axis direction lower than that of the developer supplying/collecting section, and another developer stirring section carries the developer in a direction opposite to a direction in which the developer supplying/collecting section carries the developer, and has the developer carrying capability so as to make the developer carrying amount by another developer stirring section equal to the sum total of that by the developer supplying/collecting section and the one developer stirring section.

29. The apparatus of claim 28, wherein, in the developer stirring unit, another developer stirring section having higher developer carrying capability is placed at a rear side with respect to the developer supplying/collecting unit.

30. The apparatus of claim 29, wherein the two-component developer is composed of the toner having a volume average particle diameter of 3 μm to 5 μm, and, denoting the volume average particle diameter of the toner by Dt (μm), the carrier having volume average particle diameter of 5×Dt to 10×Dt.

31. The apparatus of claim 28, wherein the developer supplying/collecting section comprises a stirring member extending spirally in the rotation axis direction throughout an outer periphery of a shaft member, the one of the two developer stirring sections having lower developer carrying capability, comprises a plurality of semioval first stirring members and a plurality of oval-semioval second stirring members on an outer periphery of a shaft member, the plurality of first stirring members being placed along a first stirring member arrangement plane, the plurality of second stirring members being placed along a second stirring member arrangement plane, the first stirring member arrangement plane and the second stirring member arrangement plane being inclined in different directions from each other with respect to a plane perpendicular to the shaft member, and has the developer carrying capability in the rotation axis direction lower than that of the developer supplying/collecting section, and another developer stirring section having higher developer carrying capability, comprises a stirring member extending spirally in the rotation axis direction throughout an outer periphery of a shaft member, and has the developer carrying capability so as to make the developer carrying amount by another developer stirring section equal to the sum total of that by the developer supplying/collecting section and the one developer stirring section.

32. The apparatus of claim 31, wherein, in the developer stirring unit, another developer stirring section having higher developer carrying capability is placed at a rear side with respect to the developer supplying/collecting unit.

33. The apparatus of claim 32, wherein the two-component developer is composed of the toner having a volume average particle diameter of 3 μm to 5 μm, and, denoting the volume average particle diameter of the toner by Dt (μm), the carrier having volume average particle diameter of 5×Dt to 10×Dt.

34. The apparatus of claim 28, wherein the developer supplying/collecting section comprises a stirring member extending spirally in the rotation axis direction throughout an outer periphery of a shaft member, the one of the two developer stirring sections having lower developer carrying capability, comprises a stirring member comprising a rib placed on an outer periphery of a shaft member or at a position with being apart from each other with respect to the shaft member in a radial direction so as to extend along the rotation axis direction, and has the developer carrying capability in the rotation axis direction lower than that of the developer supplying/collecting section, and another developer stirring section comprises a stirring member extending spirally in the rotation axis direction throughout an outer periphery of a shaft member, and has the developer carrying capability so as to make the developer carrying amount by another developer stirring section equal to the sum total of that by the developer supplying/collecting section and the one developer stirring section.

35. The apparatus of claim 34, wherein, in the developer stirring unit, another developer stirring section having higher developer carrying capability is placed at a rear side with respect to the developer supplying/collecting unit.

36. The apparatus of claim 35, wherein the two-component developer is composed of the toner having a volume average particle diameter of 3 μm to 5 μm, and, denoting the volume average particle diameter of the toner by Dt (μm), the carrier having volume average particle diameter of 5×Dt to 10×Dt.

37. An image formation apparatus comprising a latent image carrying member and a toner image formation section for forming a toner image by developing an electrostatic latent image formed on the latent image carrying member, wherein the toner image formation section includes the development apparatus of claim 28, and following conditions (1) and (2) are satisfied:

$$W \geqq M\,V\,H\,L/1000 \qquad \text{Condition (1)}$$

$$R \leqq 600 \qquad \text{Condition (2)}$$

where V represents a moving speed (mm/sec) of the latent image carrying member, M represents maximum toner amount attaching to one unit area in the toner image formed on the latent image carrying member (mg/cm$^2$), L represents maximum width (mm) of the toner image formed on the latent image carrying member in a direction perpendicular to a moving direction of the latent image carrying member, W represents developer carrying amount (g/sec) by the developer supplying/collecting section in the rotation axis direction, and R represents rotation number of the developer supplying/collecting section.

38. An image formation apparatus comprising a latent image carrying member, a toner image formation section for forming a toner image by developing an electrostatic latent image formed on the latent image carrying member, a transferring section for transferring the toner image on the latent image carrying member to transferring material or an intermediate transferring member, a cleaning section for removing toner remained on the latent image carrying member after the toner image is transferred, and a toner recycling section for collecting the toner removed from the latent image carrying member to be reused, wherein the toner image formation section includes the development apparatus of claim 28, and in the housing structuring the development apparatus, a recycled toner mixing opening is placed above the position where the two developer stirring sections face each other and at an upstream side with respect to the toner supplying opening in the developer carrying direction in the developer stirring unit, for mixing the toner collected by the toner recycling section into the developer stirring unit.

39. The apparatus of claim 28, wherein, in the developer supplying/collecting unit, peripheries of the developer carrying member and the developer supplying/collecting section are moved in opposite directions to each other at a position where the developer carrying member and the developer supplying/collecting section face each other.

40. The apparatus of claim 28, wherein, in the housing, there is a partition between the developer supplying/collecting unit and the developer stirring unit for separating space so as to avoid mixing the developer in the developer supplying/collecting unit and the developer in the developer stirring unit;

the partition enables the developer in both the developer supplying/collecting unit and the developer stirring unit to move to each other at both edge parts in a longitudinal direction of both the developer supplying/collecting unit and the developer stirring unit; and a space is secured between the two developer stirring section in the developer stirring unit so as to make the developer circulate between the two developer stirring sections freely.

41. An image formation apparatus, comprising:

an image carrying member; and a toner image formation section for forming a toner image by developing an electrostatic image formed on the image carrying member, wherein the toner image formation section includes the development apparatus of claim 1, and wherein the following conditions (1) and (2) are satisfied:

$$W \geqq M\,V\,H\,L/1000 \qquad \text{Condition (1)}$$

$$R \leqq 600 \qquad \text{Condition (2)}$$

where V represents a moving speed (mm/sec) of the image carrying member, M represents a maximum toner amount attaching to one unit area in the toner image formed on the image carrying member (mg/$cm^2$), L represents a maximum width (mm) of the toner image formed on the image carrying member in a direction perpendicular to a moving direction of the image carrying member, W represents a developer carrying amount (g/sec) by the developer supplying/collecting section in the rotation axis direction, and R represents a rotation number of the developer supplying/collecting section.

42. An image formation apparatus, comprising:

an image carrying member;

a toner image formation section for forming a toner image by developing an electrostatic image formed on the image carrying member;

a transferring section for transferring the toner image on the image carrying member to a transferring material or an intermediate transferring member;

a cleaning section for removing toner which remains on the image carrying member after the toner image is transferred; and a toner recycling section for collecting the toner removed from the image carrying member to be reused, wherein the toner image formation section includes the development apparatus of claim 1, and wherein in the housing of the development apparatus, a recycled toner mixing opening is formed above the position where the first and second developer stirring sections face each other and at the upstream side with respect to the toner supplying opening in the first developer carrying direction in the developer stirring unit, for mixing the toner collected by the toner recycling section into the developer stirring unit.

43. The apparatus of claim 1, wherein peripheries of the developer carrying member and the developer supplying/collecting section move in opposite directions with respect to each other at a position where the developer carrying member and the developer supplying/collecting section face each other.

44. The apparatus of claim 1, wherein the housing includes a partition between the developer supplying/collecting unit and the developer stirring unit to avoid mixing the developer therein, the developer moves to edge portions of both the developer supplying/collecting unit and the developer stirring unit in a longitudinal direction; and a space is formed between the first and second developer stirring sections to allow the developer to freely circulate between the first and second developer stirring sections.

* * * * *